US012410664B2

(12) United States Patent
McCormick

(10) Patent No.: US 12,410,664 B2
(45) Date of Patent: Sep. 9, 2025

(54) DEVICE FOR CENTERING A SENSOR ASSEMBLY IN A BORE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 19/051,077

(22) Filed: Feb. 11, 2025

(65) Prior Publication Data

US 2025/0179907 A1 Jun. 5, 2025

Related U.S. Application Data

(63) Continuation-in-part of application No. PCT/IB2023/058077, filed on Aug. 10, 2023.

(30) Foreign Application Priority Data

Aug. 18, 2022 (NZ) ..... 791490

(51) Int. Cl.
*E21B 17/10* (2006.01)
*E21B 47/01* (2012.01)

(52) U.S. Cl.
CPC ..... *E21B 17/1021* (2013.01); *E21B 47/01* (2013.01)

(58) Field of Classification Search
CPC .. E21B 47/01; E21B 17/1021; E21B 17/1014; E21B 17/10
See application file for complete search history.

(56) References Cited

U.S. PATENT DOCUMENTS

| | | | |
|---|---|---|---|
| 1,898,074 | A | 2/1933 | Bailey |
| 2,971,582 | A | 2/1961 | Marsh |
| 3,423,671 | A | 1/1969 | Vezin |
| 4,243,099 | A | 1/1981 | Rodgers, Jr. |
| 4,557,327 | A | 12/1985 | Kinley |
| 4,615,386 | A | 10/1986 | Briscoe |
| 4,619,322 | A | 10/1986 | Armell |

(Continued)

OTHER PUBLICATIONS

Office Action for U.S. Appl. No. 17/934,381, dated Jan. 24, 2023.

(Continued)

*Primary Examiner* — Caroline N Butcher

(74) *Attorney, Agent, or Firm* — Niels Haun; Dann, Dorfman, Herrell & Skillman, P.C.

(57) ABSTRACT

A centraliser comprises arm assemblies pivotally connected between first and second support members. Each arm assembly comprises a first arm pivotally attached to one of the first and second support members by a first pivot joint having a first pivot axis, a second arm assembly pivotally attached to the other one of the first and second support members by a second pivot joint having a second pivot axis, the first and second arms pivotally attached together via a third pivot joint having a third pivot axis. The first arm comprises a fork section extending around opposite sides of the respective first or second support member to position the first pivot axis radially within an outer diameter of a mandrel on which one or both support members move.

16 Claims, 13 Drawing Sheets

(56) References Cited

U.S. PATENT DOCUMENTS

| | | | |
|---|---|---|---|
| 4,914,826 | A | 4/1990 | Nold, III |
| 5,358,040 | A | 10/1994 | Kinley |
| 5,574,263 | A | 11/1996 | Roesner |
| 5,797,453 | A | 8/1998 | Hisaw |
| 5,971,404 | A | 10/1999 | Stoves |
| 7,505,063 | B1 | 3/2009 | Bastedo |
| 8,919,209 | B2 | 12/2014 | Furlong |
| 9,863,198 | B2 | 1/2018 | Mccormick |
| 9,963,954 | B2 | 5/2018 | Al-Mulhem |
| 10,947,791 | B1 | 3/2021 | Mccormick |
| 10,947,792 | B1 | 3/2021 | Mccormick |
| 10,988,991 | B1 | 4/2021 | Mccormick |
| 11,136,880 | B1 | 10/2021 | Mccormick |
| 11,713,627 | B1 | 8/2023 | Mccormick |
| 2003/0145985 | A1 | 8/2003 | Stuart-Bruges |
| 2003/0173076 | A1 | 9/2003 | Sheiretov |
| 2006/0067162 | A1 | 3/2006 | Blankinship |
| 2007/0181298 | A1 | 8/2007 | Sheiretov |
| 2012/0048542 | A1 | 3/2012 | Jacob |
| 2014/0238659 | A1 | 8/2014 | Wheater |
| 2016/0123143 | A1 | 5/2016 | Shaobin |
| 2016/0298396 | A1* | 10/2016 | Church ..... E21B 17/1021 |
| 2019/0063214 | A1 | 2/2019 | Castillo |
| 2019/0383108 | A1* | 12/2019 | Massey ..... E21B 17/1021 |
| 2020/0362645 | A1 | 11/2020 | Donzier |
| 2022/0228447 | A1* | 7/2022 | Donzier ..... E21B 47/01 |

OTHER PUBLICATIONS

PCT written opinion for int. patent application PCT/IB2023/058077, dated Sep. 29, 2023.

International search report for int. patent application PCT/IB2023/058077, dated Sep. 29, 2023.

Notice of Allowance for U.S. Appl. No. 17/934,381, dated Mar. 8, 2023.

* cited by examiner

DEVICE FOR CENTERING A SENSOR ASSEMBLY IN A BORE

CORRESPONDING APPLICATION

This application is a continuation in part under 35 U.S.C. 365(c) of International Application PCT/IB2023/058077, filed Aug. 10, 2023, which claims the benefit of priority of New Zealand Patent Application Number 791490, filed Aug. 18, 2022. The entire contents of all recited Patent Applications are herein incorporated by reference.

TECHNICAL FIELD

This invention relates to devices for use in centering sensor equipment down a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor are mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by the wireline cable down the wellbore under the force of gravity alone. The cable, being flexible, cannot push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction to reduce the drag force. The coefficient of friction may be reduced by utilising low friction materials, such as Teflon. The drag force may also be reduced by using wheels.

A common apparatus to centralise logging tools is a bow-spring centraliser. Bow-spring centralisers incorporate a number of curved leaf springs. The leaf springs are attached at their extremities to an attachment structure that is fixed to the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened and the flattened bow springs provide a centering force on the tool string. In deviated wells this centering force must be greater than the lateral weight component of the tool string acting perpendicular to the wellbore or casing wall. Consequently, more centering force is required at greater well deviations. If the centering force is too small the centraliser will collapse and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small diameter wellbores, as the leaf springs have greater deflection (more compressed), than in large diameter wellbores. Consequently, stronger or multiple bowsprings are required in larger hole sizes. These centralisers usually have "booster" kits to impart more centering force in larger wellbores or those with higher deviations.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leafspring or over-powering persist.

Another known type of centraliser consists of a set of levers or arms with a wheel at or near where the levers are pivotally connected together. There are multiple sets of lever-wheel assemblies disposed at equal azimuths around the central axis of the device. There are typically between three and six sets. The ends of each lever set are connected to blocks which are free to slide axially on a central mandrel of the centraliser device. Springs are used force these blocks to slide toward each other forcing the arms to defect at an angle to the centraliser (and tool string) axis so that the wheels can extend radially outward to exert force against the wellbore wall. With this type of device, the centering force depends on the type and arrangement of the energising apparatus or springs.

The centraliser device is typically energised by means of either axial or radial spring or a combination of both. The advantage of this type of centraliser is that drag is reduced by the wheels which roll, rather than slide along the wellbore wall.

A significant issue with lever-wheel centralisers is that these centralisers can fail in their ability to centralise a tool string in a well bore, due to a failure in the transfer of the radial movement of one arm to the other arms via the sliding blocks. The failure of these devices to centralise a tool string is exacerbated in smaller diameter well bores when the angle between the arms and the centreline of the centraliser is small. For example, at an arm angle of 10 degrees, a change in the wellbore diameter of 10 mm (5 mm radial displacement) results in an axial displacement of less than 1 mm.

With such a small axial movement of the sliding blocks, clearances between mechanical components such as in pivot points, bearings and the sliding members causes the centraliser device to fail to centralise the tool string since the radial displacement of one of the arm assemblies is not transferred sufficiently accurately to other arm assemblies through the sliding blocks. This results in the tool string running off centre which in turn can cause the tool string sensors to return erroneous data. Extreme high precision tolerancing between parts is required to ensure all arms deflect in unison to achieve centralisation. Machining tolerances required to achieve centralisation at low arm angles may be impractical.

A centraliser device may also be energised by spring devices that directly exert a radially outward force. Such spring devices may be coil springs, torsion springs or leaf springs acting between the centraliser arm and arm support member or a central mandrel. With leaf springs acting on the hinged arms or coil springs arranged radially from the centraliser/tool string axis the limitations described above still apply. Namely, the centralising force is greater in small diameter wellbores, where the springs undergo greater deflection, than in large diameter wellbores. At increased well deviations, more centering force is required. If the centering force is too small the centraliser will collapse and the tool sensors are not centered. If the centralising force is too great the excessive force will induce unwanted drag which may prevent the tool descending or cause stick-slip motion of the logging tool. At low arm angles the radial force may be increased by including radial booster springs, however this will not correct the fundamental problem of centralisation caused by a failure to couple radial movement of the arms together at the sliding blocks. The logging tool may run off centre by a distance determined by the tool weight acting perpendicular to the well bore wall and the spring stiffness of the radial springs.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for centering a sensor assembly in a bore, the device comprising:

- a first support member and a second support member axially spaced apart along a central longitudinal axis of the device, one or both of the first and second support members configured to move axially along the central longitudinal axis,
- a plurality of arm assemblies pivotally connected between the first and second support members, wherein each arm assembly comprises:

- a first arm pivotally attached to one of the first and second support members by a first pivot joint having a first pivot axis, a second arm pivotally attached to the other one of the first and second support members by a second pivot joint having a second pivot axis, the first and second arms pivotally attached together via a third pivot joint having a third pivot axis, and
- wherein the first arm comprises a fork section extending around opposite sides of the respective first or second support member to position the first pivot axis radially within an outer diameter of a mandrel on which one or both support members move axially.

In some embodiments, the fork section extends around opposite sides of the respective first or second support member to position the first pivot axis and third pivot axis on the same side of a plane coincident with the central longitudinal axis.

In some embodiments, the fork section extends around opposite sides of the respective first or second support member to position the first pivot axis coincident with the central longitudinal axis.

In some embodiments, the fork section extends around opposite sides of the respective first or second support member to position the first pivot axis and third pivot axis on opposite sides of a plane coincident with the central longitudinal axis.

In some embodiments, the first arm is pivotally attached to the respective first or second support member by a pair of colinear pivot joints spaced apart by the forked section, the pivot joints located on opposite sides of the first or second support member.

In some embodiments, the first and second pivot axes are fixed at the respective first and second support members.

In some embodiments, the support member(s) comprise a collar or annular member colinear with and received on the mandrel to slide thereon. The collar or annular support member is received around the outside of the mandrel to slide there on.

The first pivot axis extends through the mandrel on which the first and/or second support member slides. In some embodiments the device is configured as a slip over device, wherein the mandrel comprises an internal bore configured to slip over an outside of a wireline logging tool (housing), and wherein the first pivot axis extends through the bore of the mandrel. Thus, in some embodiments, the first pivot axis extends through the tool string on which the device is assembled in use.

In some embodiments, the arm assemblies are arranged in two diametrically opposite pairs, a first pair of diametrically opposite arm assemblies and a second pair of diametrically opposite arm assemblies, and wherein

- in the first pair of diametrically opposite arm assemblies, the first arms are pivotally connected to the first support member and the second arms are pivotally connected to the second support member, and
- in the second pair of diametrically opposite arm assemblies, the first arms are pivotally connected to the second support member and the second arms are pivotally connected to the first support member.

In some embodiments, for each arm assembly in the first pair of diametrically opposite arm assemblies, the first pivot axis is coincident with a first plane coincident with the central longitudinal axis of the device, or the first pivot axis and the third pivot axis are positioned on opposite sides of the first plane, and

- for each arm assembly in the second pair of diametrically opposite arm assemblies, the first pivot axis is coincident with a second plane coincident with the central longitudinal axis of the device, or the first pivot axis and the third pivot axis are positioned on opposite sides of the second plane, wherein the second plane is orthogonal to the first plane.

In some embodiments, in the first pair of diametrically opposite arm assemblies, the first pivot axes are coincident with the first plane, and

- in the second pair of diametrically opposite arm assemblies, the first pivot axes are coincident with the second plane.

In some embodiments, in each pair of diametrically opposite arm assemblies, the first pivot axes of the pair of arm assemblies are colinear, such that the first arms pivot on the respective first or second support member on a common pivot axis.

In some embodiments, the first pair of diametrically opposite arm assemblies comprises a first said arm assembly and a second said arm assembly, and the first pivot axis of the first arm assembly is collinear with the first pivot axis of the second arm assembly, and the second pair of diametrically opposite arm assemblies comprises a third said arm assembly and a fourth said arm assembly, and the first pivot axis of the third arm assembly is collinear with the first pivot axis of the fourth arm assembly.

In some embodiments, in each pair of diametrically opposite arm assemblies:

one of the first arms comprises a pair of colinear pivot pins spaced apart by the fork section, the other one of the first arms comprises a pair of colinear eyes spaced apart by the fork section, the eyes received on the pins, and the pins received in corresponding bearing portions on opposed sides of the respective first or second support member to pivotally connect the first arms to the respective first or second support member to pivot on the respective first or second support member on a common pivot axis.

In some embodiments, the first arm comprising a fork section with eyes is captured between the support member and the first arm comprising a fork section with pins.

In some embodiments, the first arm comprising the pivot pins is provided in two parts, each part providing one limb of the fork section with a corresponding pin, and wherein the two parts are assembled on the support member with the pins received in the bearing portions to retain and pivotally connect the two first arms to the support member.

In some embodiments, the first pivot axes are coincident with the central longitudinal axis of the device.

In some embodiments, in the first pair of diametrically opposite arm assemblies, the first pivot axis and the third pivot axis are positioned on opposite sides of the first plane, and in the second pair of diametrically opposite arm assemblies, the first pivot axis and the third pivot axis are positioned on opposite sides of the second plane.

In some embodiments, in each pair of arm assemblies, the first pivot axes of the first pair of diametrically opposite arm assemblies are axially aligned at the first support member, and the first pivot axes of the second pair of diametrically opposite arm assemblies are axially aligned at the second support member.

In some embodiments, the fork sections of the first pair of diametrically opposite arm assemblies laterally cross over such that the first pivot axis and the third pivot axis of each arm assembly in the first pair of diametrically opposite arm assemblies are positioned on opposite sides of the first plane, and the fork sections of the second pair of diametrically opposite arm assemblies laterally cross over such that the first pivot axis and the third pivot axis of each arm assembly in the second pair of diametrically opposite arm assemblies are positioned on opposite sides of the second plane.

In some embodiments, the first arm of each arm assembly comprises an elongate section extending between the fork section and the third pivot joint.

In some embodiments, the first arm of each arm assembly comprises a non-bifurcated section between the fork section and the third pivot joint, and the forked section comprises two limbs diverging from the non-bifurcated section to extend around opposite sides of the respective first or section support member.

In some embodiments, in each pair of diametrically opposite arm assemblies, the forked section of one first arm is received radially inside the fork section of the other first arm.

In some embodiments, each arm assembly comprises a roller or wheel to contact the bore wall.

In some embodiments, the wheel is rotationally coupled to the respective first arm and/or second arm on an axis of rotation perpendicular to the longitudinal axis of the device at or adjacent to the third pivot axis.

In some embodiments, the device comprises one or more spring elements to bias the arm assemblies radially outwards.

In some embodiments, the one or more spring elements act on the first support member and/or the second support member to bias the first and second support members axially together and the arm assemblies radially outwards.

In some embodiments, the device is a passive device, with energisation of the arm assemblies radially outwards being provided by the one or more spring elements of the device only.

According to a second aspect of the present invention there is provided a device for centering a sensor assembly in a bore, the device comprising:

a first support member and a second support member axially spaced apart along a central longitudinal axis of the device, one or both of the first and second support members configured to move axially along the central longitudinal axis;

a first pair of diametrically opposite arm assemblies and a second pair of diametrically opposite arm assemblies orthogonal to the first pair of diametrically opposite arm assemblies, each arm assembly comprising a first arm and a first pivot joint having a first pivot axis, a second arm and a second pivot joint having a second pivot axis, and the first and second arms pivotally attached together via a third pivot joint having a third pivot axis, for each arm assembly in the first pair of diametrically opposite arm assemblies:

the first arm is pivotally connected to the first support member by the first pivot joint, the second arm is pivotally connected to the second support member by the second pivot joint, and the first pivot axis is radially within an outer diameter of a mandrel on which one or both support members move axially, and for each arm assembly in the second pair of diametrically opposite arm assemblies:

the first arm is pivotally attached to the second support member by the first pivot joint, the second arm is pivotally connected to the first support member by the second pivot joint, and the first pivot axis is radially within an outer diameter of a mandrel on which one or both support members move axially.

In some embodiments, for each arm assembly in the first pair of diametrically opposite arm assemblies, the first pivot axis and the third pivot axis are on the same side of a first plane coincident with the central longitudinal axis, and for each arm assembly in the second pair of diametrically opposite arm assemblies, the first pivot axis and the third pivot axis are on the same side of a second plane coincident with the central longitudinal axis, the second plane orthogonal to the first plane.

In some embodiments, for each arm assembly in the first pair of diametrically opposite arm assemblies, the first pivot is coincident with a first plane coincident with the central longitudinal axis of the device, and for each arm assembly in the second pair of diametrically opposite arm assemblies, the first pivot is coincident with a second plane coincident with the central longitudinal axis of the device, the second plane orthogonal to the first plane.

In some embodiments, for each arm assembly in the first pair of diametrically opposite arm assemblies, the first pivot axis and the third pivot axis are positioned on opposite sides of a first plane coincident with the central longitudinal axis of the device, and for each arm assembly in the second pair of diametrically opposite arm assemblies, the first pivot axis and the third pivot axis are positioned on opposite sides of a second plane coincident with the central longitudinal axis of the device, the second plane orthogonal to the first plane.

In some embodiments, the first arm of each arm assembly comprises a fork section extending around opposite sides of the respective first or second support member.

In some embodiments, the first arm of each arm assembly comprises an elongate section extending between the fork section and the third pivot joint.

In some embodiments, the first pair of diametrically opposite arm assemblies comprises a first said arm assembly and a second said arm assembly, and the first pivot axis of the first arm assembly is colinear with the first pivot axis of the second arm assembly, and the second pair of diametrically opposite arm assemblies comprises a third arm assembly and a fourth arm assembly, and the first pivot axis of the third arm assembly is colinear with the first pivot axis of the fourth arm assembly.

In some embodiments, in each pair of arm assemblies, the first pivot axes of the two arm assemblies are axially aligned.

According to a third aspect of the present invention there is provided a device for centering a sensor assembly in a bore, the device comprising:

a first support member and a second support member axially spaced apart along a central longitudinal axis of the device, one or both of the first and second support members configured to move axially along the central longitudinal axis, a plurality of arm assemblies pivotally connected between the first and second support members, wherein each arm assembly comprises:

a first arm pivotally attached to one of the first and second support members by a first pivot joint having a first pivot axis, a second arm pivotally attached to the other one of the first and second support members by a second pivot joint having a second pivot axis, the first and second arms pivotally attached together via a third pivot joint having a third pivot axis, and wherein the first arm comprises a fork section extending around opposite sides of the respective first or second support member to position the first pivot axis coincident with the central longitudinal axis of the device.

In the third aspect, the first pivot axis is radially within an outer diameter of a mandrel on which one or both support members move axially.

According to a fourth aspect of the present invention there is provided a device for centering a sensor assembly in a bore, the device comprising:

a first support member and a second support member axially spaced apart along a central longitudinal axis of the device, one or both of the first and second support members configured to move axially along the central longitudinal axis, a plurality of arm assemblies pivotally connected between the first and second support members, wherein each arm assembly comprises:

a first arm pivotally attached to one of the first and second support members by a first pivot joint having a first pivot axis, a second arm pivotally attached to the other one of the first and second support members by a second pivot joint having a second pivot axis, the first and second arms pivotally attached together via a third pivot joint having a third pivot axis, and wherein the first arm comprises a fork section extending around opposite sides of the respective first or second support member so that the first pivot axis and the third pivot axis are positioned on opposite sides of a plane coincident with the central longitudinal axis of the device.

In the fourth aspect, first pivot axis may be positioned radially within an outer diameter of a mandrel on which one or both support members move axially or may be positioned radially outside the OD of the mandrel.

According to a fifth aspect of the present invention there is provided a device for centering a sensor assembly in a bore, the device comprising:

a first support member and a second support member axially spaced apart along a central longitudinal axis of the device, one or both of the first and second support members configured to move axially along the central longitudinal axis, a plurality of arm assemblies pivotally connected between the first and second support members, wherein each arm assembly comprises:

a first arm pivotally attached to one of the first and second support members by a first pivot joint having a first pivot axis, a second arm assembly pivotally attached to the other one of the first and second support members by a second pivot joint having a second pivot axis, the first and second arms pivotally attached together via a third pivot joint having a third pivot axis, and wherein the first arm comprises a fork section extending around opposite sides of the respective first or second support member to position the first pivot axis and the third pivot axis on the same side of a plane coincident with the central longitudinal axis.

The second, third, fourth, and/or fifth aspect of the invention may comprise one or more of the features described above in relation to the first aspect of the invention.

According to a sixth aspect of the present invention there is provided a wireline logging tool string comprising one or more elongate sensor assemblies and a device according to the first, second, third, fourth, or fifth aspect of the invention described above, the device for centering the wireline logging tool string in a wellbore during a wireline logging operation.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool" and may include components other than sensors such as guide and orientation devices and carriage devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is a side view of the centraliser with arm assemblies of the centraliser in a radially outward position corresponding with a larger wellbore diameter. FIG. 2B is a side view with the arm assemblies in a radially inward position corresponding with a smaller wellbore diameter. FIG. 2C is an end view of the centraliser in the radially outward position. FIG. 2D is an end view of the centraliser in the radially inward position. FIGS. 2E and 2F are isometric views again showing the arm assemblies in the radially outward and radially inward positions.

FIG. 3A is a side view of the centraliser with arm assemblies of the centraliser in a radially outward position corresponding with a larger wellbore diameter. FIG. 3B is a side view with the arm assemblies in a radially inward position corresponding with a smaller wellbore diameter. FIG. 3C is an end view of the centraliser in the radially outward position. FIG. 3D is an end view of the centraliser in the radially inward position. FIGS. 3E and 3F are isometric views again showing the arm assemblies in the radially outward and radially inward positions.

FIG. 4A is a sectional view on line A-A in FIG. 4B, FIG. 4B is a side view, and FIG. 4C is an exploded trimetric view. The first arms are pivoted to a position intermediate the radially inward and radially outward positions.

FIG. 5A is a side view of the centraliser with arm assemblies of the centraliser in a radially outward position corresponding with a larger wellbore diameter. FIG. 5B is a side view with the arm assemblies in a radially inward position corresponding with a smaller wellbore diameter. FIG. 5C is an end view of the centraliser in the radially outward position. FIG. 5D is an end view of the centraliser in the radially inward position. FIGS. 5E and 5F are isometric views again showing the arm assemblies in the radially outward and radially inward positions.

FIGS. 7A and 7B are side and end views with the arm assemblies of the centraliser in a radially inwards position. FIGS. 7C and 7D are side and end views with the arm assemblies of the centraliser in a radially outwards position.

FIG. 8A is a side view of the centraliser with arm assemblies of the centraliser in a radially outward. FIG. 8B is a side view with the arm assemblies in a radially inward position. FIG. 8C is an end view of the centraliser in the radially outward position. FIG. 8D is an end view of the centraliser in the radially inward position. FIGS. 8E and 8F are isometric views again showing the arm assemblies in the radially outward and radially inward positions.

BEST MODES FOR CARRYING OUT THE INVENTION

Figure 1:
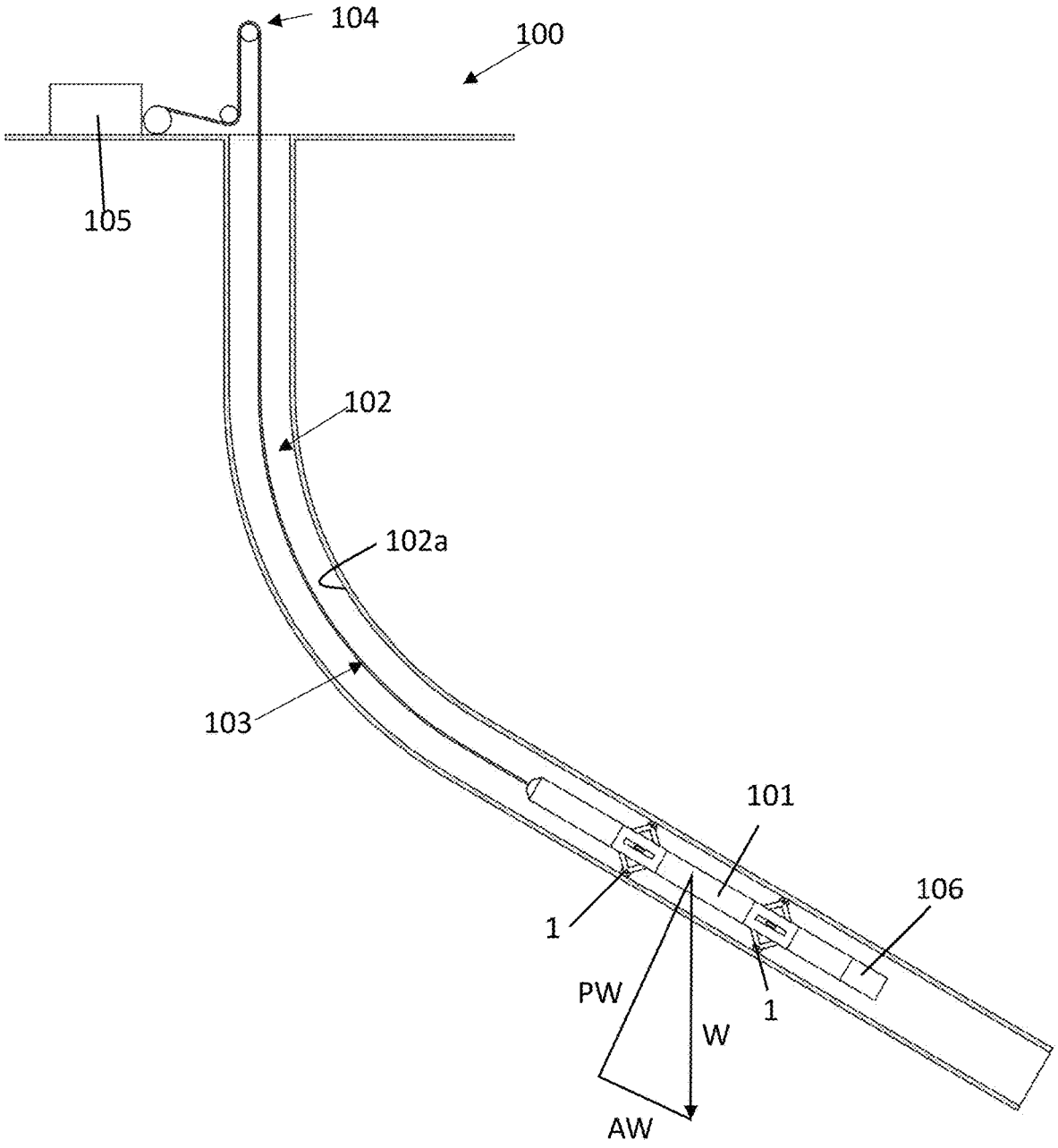
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 102 includes a number of wires or cables to provide electrical power to the one or more sensors 106 and transmit sensor data to the wellsite surface. One or more centralising devices 1 are provided to the logging tool 101 to centralise the logging tool 101 in the wellbore 102.

FIGS. 2A to 2F illustrate a centralising device 1 to be provided with or as part of the tool string 101. The centralising device (or centraliser) comprises a coupling 2 or interface (illustrated schematically) at each end to connect the centraliser 1 to other components of the tool string 101. The couplings may include electrical or hydraulic connections to provide electrical and hydraulic communication from the wireline to the wireline logging tool and/or between wireline tools. Alternatively, the centraliser device may be integral with the wireline logging tool, e.g. the outer housing of the logging tool may form a central mandrel of the centraliser. Alternatively, the centraliser device may slip over the outside of the wireline logging tool (housing) thereby avoiding any electrical or hydraulic connections with the tool string and wireline. The couplings or interfaces may be any suitable coupling or interface known in the art.

A plurality of arm assemblies (linkages) 3 are spaced circumferentially apart around a longitudinal axis 4 of the device 1. The arm assemblies 3 are configured to move axially and radially to engage the wellbore wall 102*a* to provide a centering force to maintain the tool string 101 in the centre of the wellbore 102.

The arm assemblies 3 are pivotally coupled between two support members, a first support member 7 and a second support member 8. Each arm assembly or linkage comprises a first arm or link 5 pivotally connected to one of the support members 7, 8 by a first pivot joint 11 having a first pivot axis 11*a*, and a second arm or link 6 pivotally connected to the other one of the support members 7, 8 by a second pivot joint 12 having a second pivot axis 12*a*. The first and second pivot axes are fixed at the respective first and second support members. The first and second arms 5, 6 a pivotally attached via a third pivot joint 13 having a third pivot axis 13*a*. One or both of the support members 7, 8 are configured to move axially along a longitudinal axis 4 of the device 1 to cause the arm assemblies to move radially to engage the wellbore wall by pivoting of the first and second arms 5, 6 about the respective first 11*a*, second 12*a* and third 13*a* pivot axes. One or both support members 7, 8 may slide axially on a central member or mandrel 10 of the centraliser or on a body of the tool string. The support member(s) may comprise a collar or annular member colinear with and received on the mandrel 10 to slide thereon. The collar or annular support member is received around the outside of the mandrel to slide there on. The support members 7, 8 may be keyed to the mandrel to rotationally fix the support members to the mandrel so that the support members move axially on the mandrel without relative rotation between the support members and the mandrel.

Figure 2A:
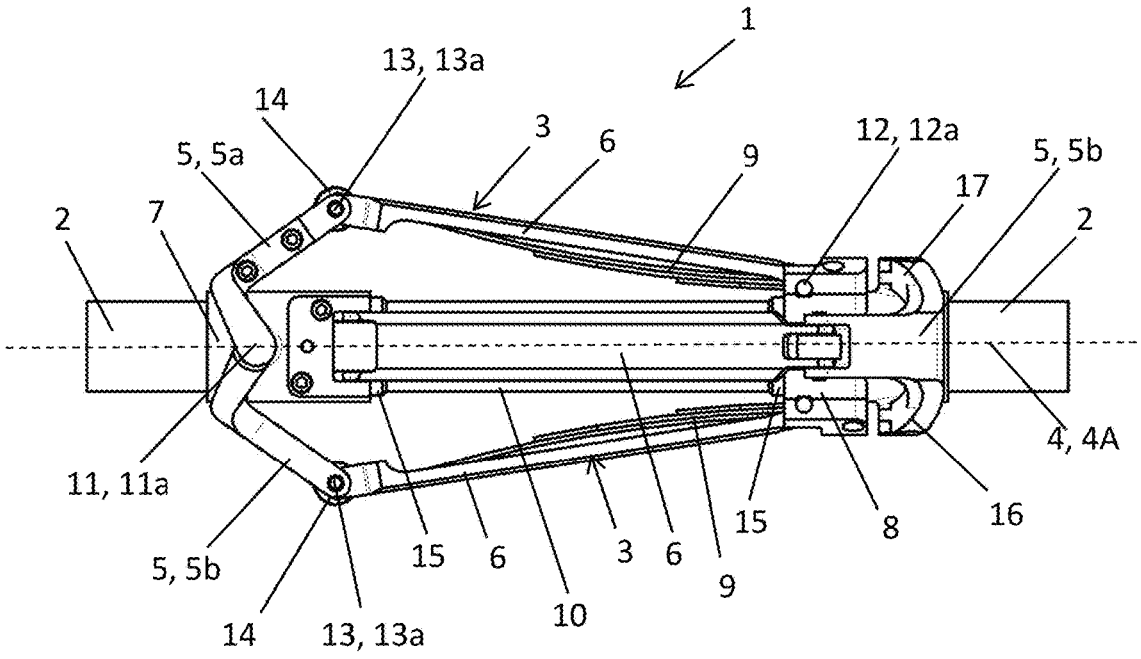
FIGS. 2A to 2F provide schematic representations of a centralising device (a centraliser) according to one example of the present invention.
Figure 2B:
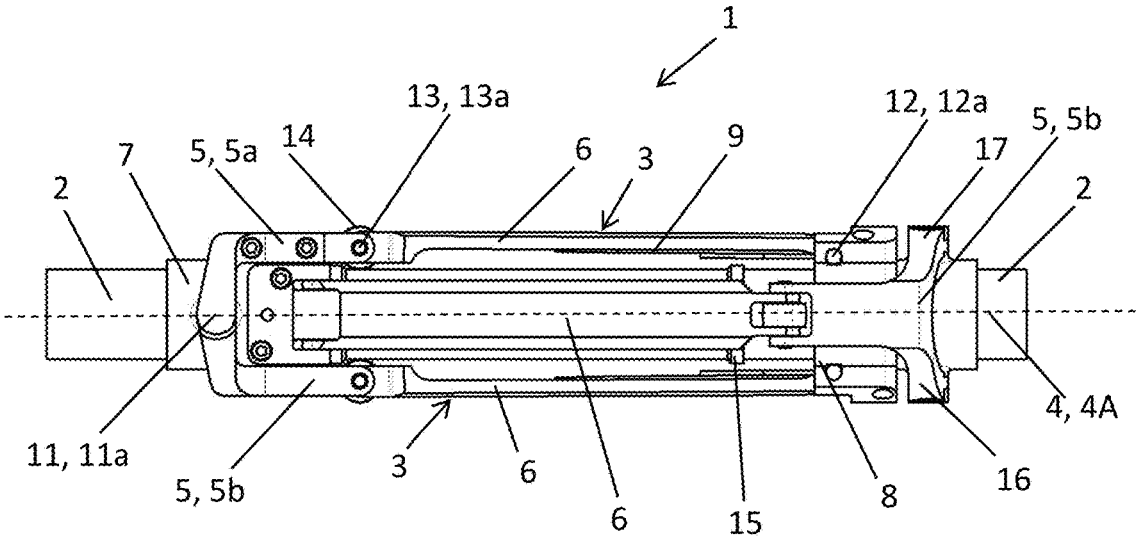
Figure 2C:
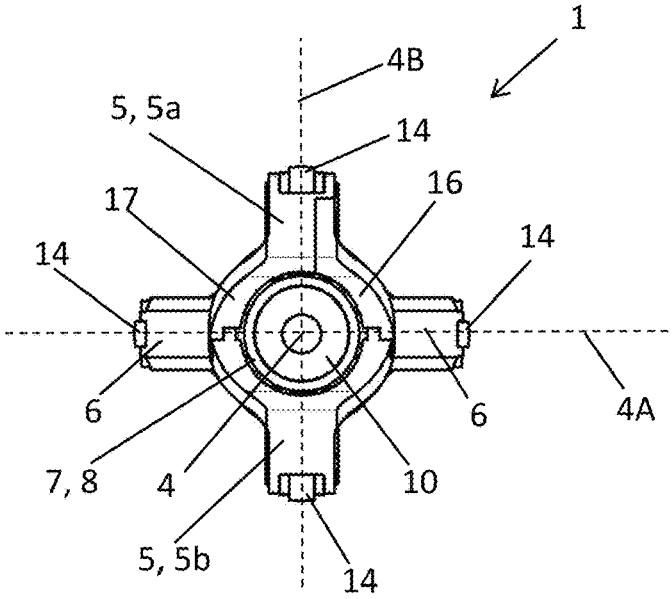
Figure 2D:
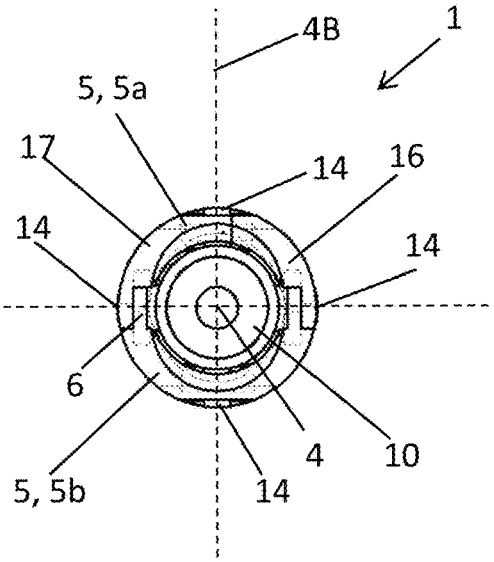
Figure 2E:
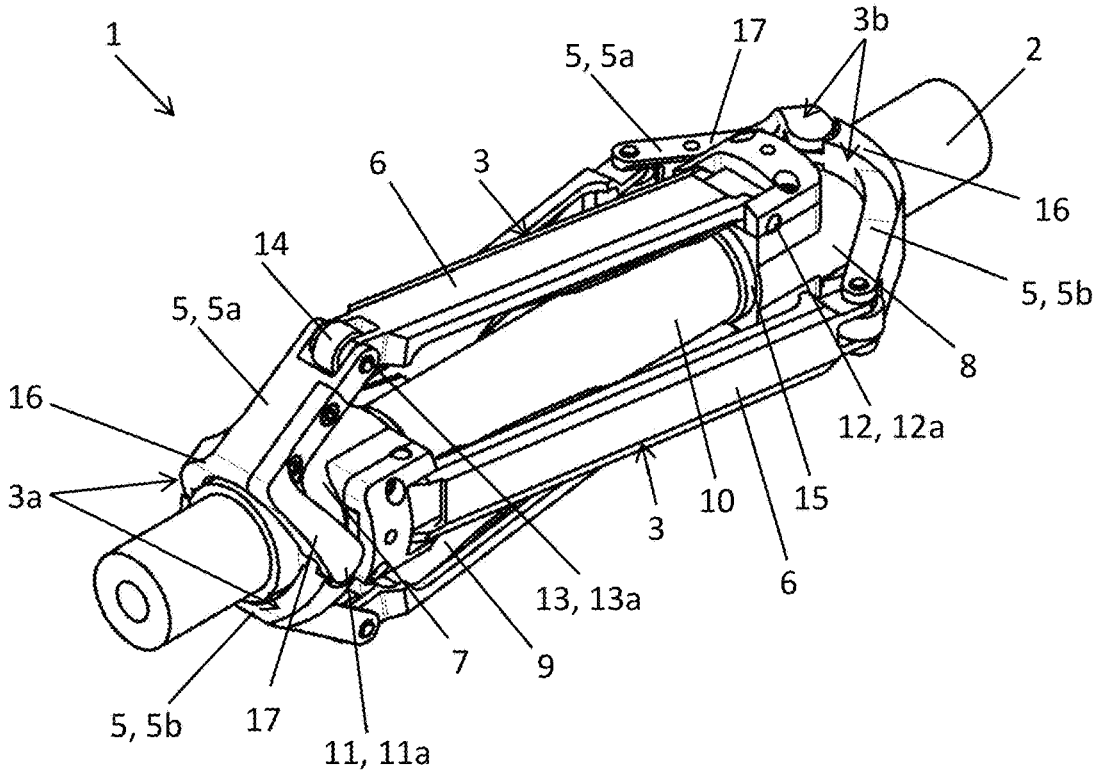
Figure 2F:
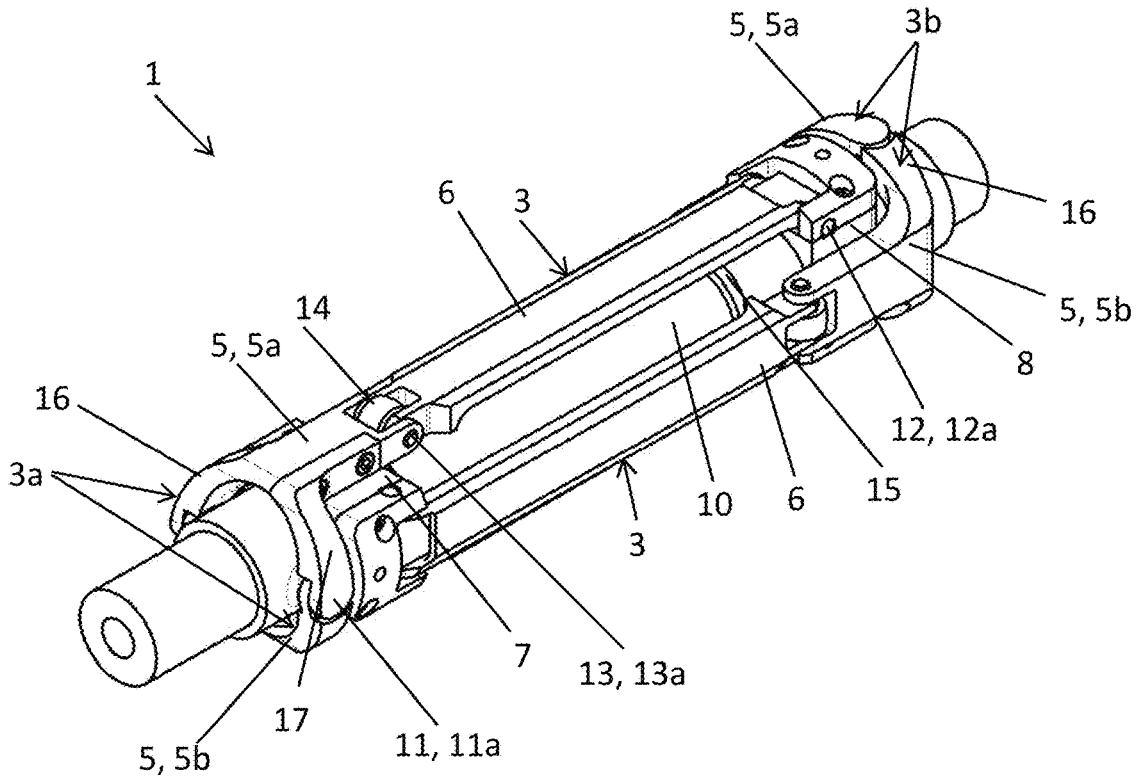
Figure 3A:
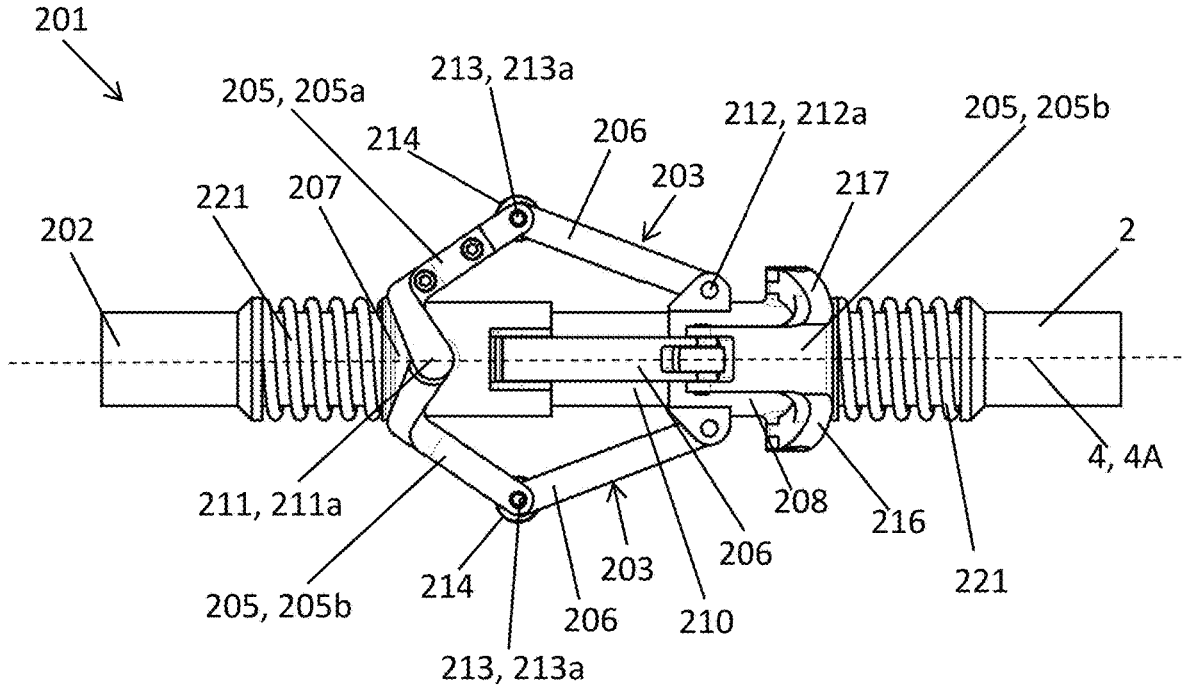
FIGS. 3A to 3F provide schematic representations of a centralising device according to another example of the present invention.
Figure 3B:
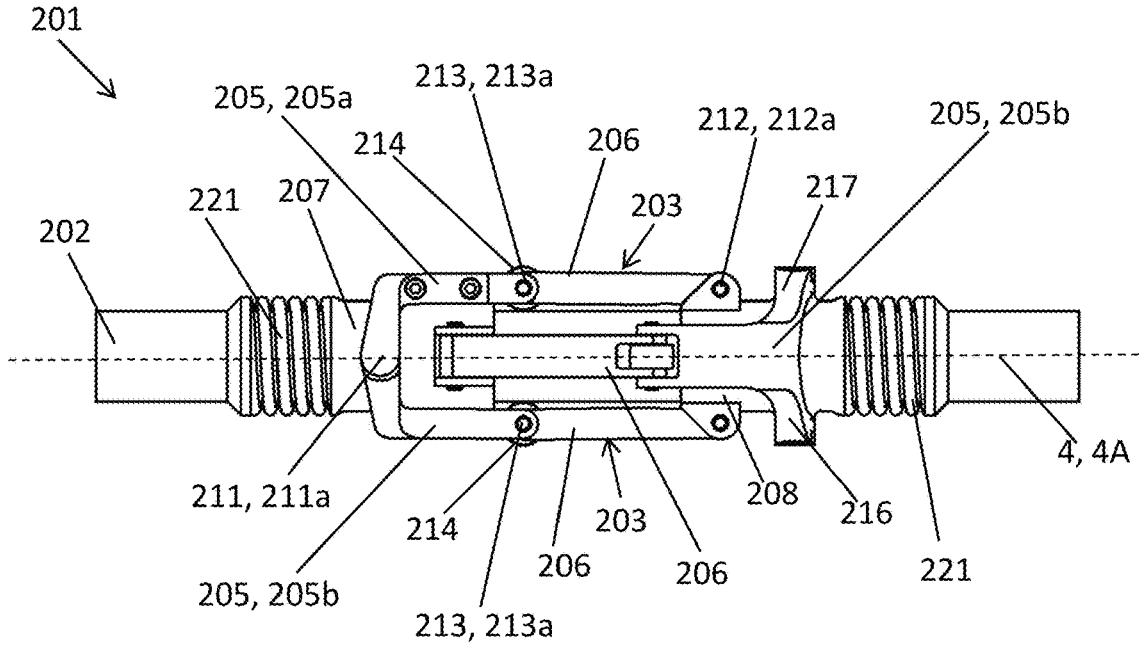
Figure 3C:
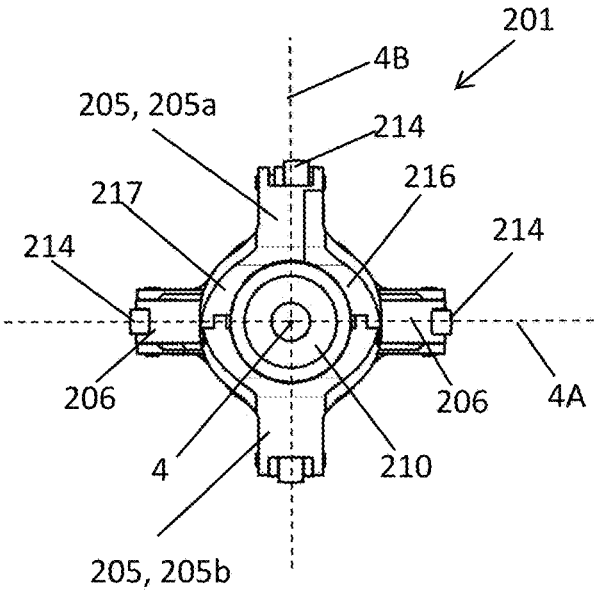
Figure 3D:
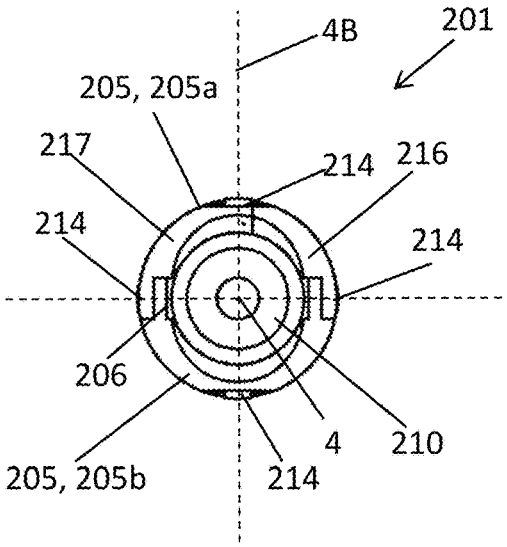
Figure 3E:
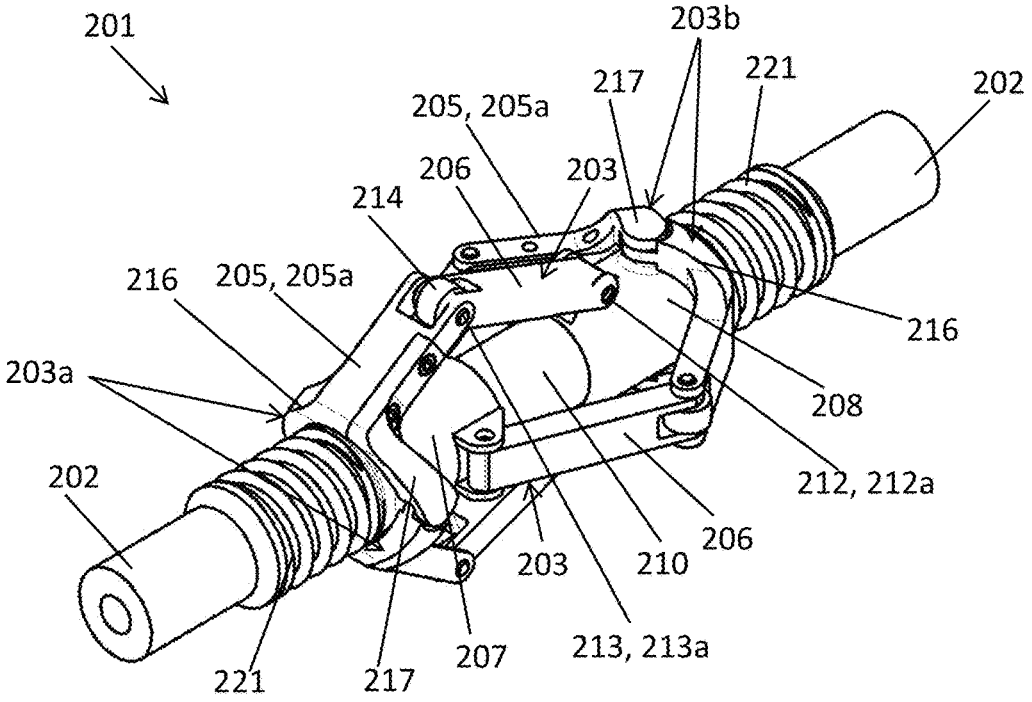
Figure 3F:
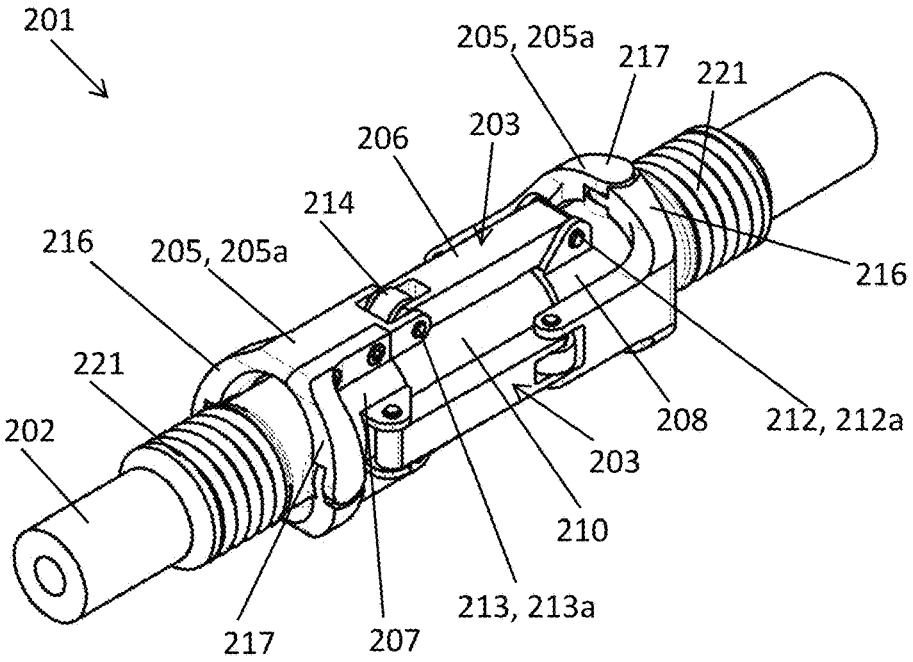

Each arm assembly 3 carries a roller or wheel 14 (herein wheel) to contact the wellbore wall to reduce friction between the wellbore wall 102*a* and the tool string 101 as the tool string 101 traverses the well bore 102. The wheel 14 is located at or adjacent the third pivot joint 13. The wheel 14 may have a rotational axis colinear with the pivot axis 13*a* of the third pivot joint 13 as shown in FIG. 2A or may be located adjacent the third pivot joint 13, for example the wheel may be rotationally mounted to the first arm 5 or the second arm 6 adjacent the third pivot joint 13. Springs 9 (most visible in FIG. 2A) are provided to bias the arm assemblies 3 radially outwards against the wellbore wall 102*a*, to center the centraliser 1 and connected tool string in the wellbore.

A mechanical stop 15 may be provided on the mandrel to set a maximum diameter for the centraliser 1. Each stop 15 limits axial movement of the respective support member 7, 8 to limit the radial outward movement of the arm assemblies 3 and therefore the outer diameter of the device 1.

The radial extremities of the centraliser provided by the wheels 14 together present or define the outer diameter of the centraliser. The springs 9 provide a radial force to the arm assemblies 3 with the wheels 14 at the maximum outer diameter so that the centraliser supports the sensor assembly at the maximum outer diameter as it traverses along a bore. Prior to running the centraliser into a bore or where the centraliser 1 enters a large diameter section in the wellbore, the mechanical stops 15 prevent the arm assemblies 3 extending radially outside a desired diameter range, to avoid for example difficulties with inserting the device 1 into a bore or passing from a larger diameter to a smaller diameter section of the wellbore or passing through a wellhead control assembly.

The first arm 5 of each arm assembly 3 comprises a fork section comprising two limbs 16, 17. The fork section extends around opposite sides of the corresponding or respective support member 7, 8 relative to a plane in which the arm assembly moves radially between radially inward and radially outward positions. The limbs 16, 17 of the fork of the first arm 5 extend on opposed sides of the support member 7, 8. By extending around opposed sides of the support member 7, 8, the fork section positions the first pivot axis 11*a* further from the third pivot axis 13*a*, thereby increasing the effective length of the first arm 5 compared to an arm comprising a first pivot axis on a side of the support member 7, 8 facing the third pivot joint. Positioning the first pivot axis 11*a* further from the third pivot joint via the fork section extending around opposed sides of the support member also increases an angle of the first arm relative to the longitudinal axis 4 of the device 1.

Extending the arm length increases a bore diameter range over which the centraliser 1 can operate. Furthermore, increasing the minimum arm angle improves the coupling of the arm assemblies 3 together, since a larger arm angle results in a greater axial displacement of the support member 7, 8 for a given radial displacement of the arm assembly 3. Effective coupling the radial movement of the plurality of arm assemblies 3 is critical to ensure the arm assemblies act together in unison to accurately centralise the device and tool string in the bore. To ensure effective coupling between the arm assemblies 3, the arm angle (angle A, FIG. 4B) between at least one of the arms in the arm assemblies should not be less than about 10 degrees. Preferably the minimum angle of at least one of the two arms 5, 6 should be at least 10 degrees, or at least 15 degrees, or at least 20 degrees, or at least 25 degrees. In the illustrated embodiment, the minimum angle of the first arm when the arm assemblies are in the radially inwards position is 25 degrees.

It is to be understood that the angle between an arm and the central axis is an angle between a line extending through the pivot axes at respective ends of the arm and the longitudinal axis of the device 1. For example, with reference to FIG. 4B, the angle between the first arm 5 and the longitudinal axis 4 is the angle A between a line extending through the first and third pivot axes 11*a*, 13*a* and the longitudinal axis 4. It is to be understood that the effective length of the arm is the distance between the pivot axes at respective ends of the arm. For example, the length of the first arm 5 is the distance between the first and third pivot axes 11*a*, 13*a*.

In the illustrated example device 1, the fork section extends around opposed sides of the support member 7, 8 so that the first pivot axis 11*a* is coincident with the longitudinal axis 4 of the device 1. Alternatively, as described below with reference to FIGS. 5A to 5F, the fork section may extend around opposed sides of the support member 7, 8 so that the first pivot axis 11*a* is on an opposite side of a plane 4A, 4B coincident with the longitudinal axis 4 of the device 1 to the third pivot axis 13*a*, in other words, the first 11*a* and third 13*a* pivot axes are on opposite sides of the plane 4A, 4B. The fork section may extend around opposed sides of the support member 7, 8 so that the first pivot axis 11*a* is located radially within an outer diameter of the mandrel 10 on which one or both support members move. For example, in a further alternative embodiment shown in FIGS. 8A to 8F, the first pivot 11*a* and third pivot 13*a* axes may be located on the same side of the plane 4A, 4B, with the first pivot axis 11*a* located radially within the OD of the mandrel 10. In the illustrated example, the second pivot axis 12*a* is on the same side of the plane 4A, 4B to the third pivot axis 13*a*.

The arm assemblies 3 must be located within a limited annular space between the mandrel 10 and the inner diameter of the bore 102. The forked arm arrangement achieves a compact configuration for efficient utilisation of the available annular space.

A compact arm assembly arrangement is further achieved by arranging the arm assemblies 3 in two diametrically opposite pairs—a first pair 3*a* of diametrically opposite arm assemblies and a second pair 3*a* of diametrically opposite arm assemblies, as illustrated in the example of FIGS. 2A to 2F, such that the centraliser 1 has four arm assemblies 3. A diametrically opposite pair of arm assemblies means the two arm assemblies of the pair are positioned on opposite sides of the central mandrel 10 to be azimuthally misaligned by 180 degrees with respect to the central longitudinal axis 4 of the device 1. With the arm assemblies diametrically opposite, the wheels 14 of the pair of arm assemblies are azimuthally misaligned by 180 degrees to contact the wellbore wall on opposite sides of the well bore. The second pair 3*b* of arm assemblies is orthogonal to the first pair 3*a* of arm assemblies, such that the arm assemblies 3 (and wheels 14 of the device 1) are azimuthally spaced apart by 90 degrees. Thus, the pivot axes 11*a*, 12*a*, 13*a* of the pivot joints 11, 12, 13 of the arm assemblies in the first pair 3*a* are orthogonal to the pivot axes 11*a*, 12*a*, 13*a* of the pivot joints 11, 12, 13 of the arm assemblies in the second pair 3*b*.

The two pairs of arm assemblies 3 are arranged so that the first arms 5 of the arm assemblies 3 in the first pair are pivotally coupled to the first support member 7, and the first arms 5 of the arm assemblies 3 in the second pair are pivotally coupled to the second support member 8. This arrangement provides for two diametrically opposite forked arm connections at each support member 7, 8 and avoids interference between the forked arms at each support member as the arms pivot between radially inward and radially outward positions.

In the illustrated example, to accommodate the first 11 and second 12 pivot joints at each support member 7, 8, the first pair of diametrically opposite arm assemblies is axially offset from the second pair of diametrically opposite arm assemblies, with the second pivot joints 12 located towards an axially inward side of the first pivot joints 11, i.e. the second pivot joints 12 of the first (or second) pair of arm assemblies are located axially between the first pivot joints 11 of the first (or second) pair of arm assemblies and the first pivot joints 11 of the second (or first) pair of arm assemblies. This results in the first arms being at distal ends of the device 1 such that when the device 1 passes from a larger bore diameter to a smaller bore diameter, a step in the bore diameter impacts the first arm. This may achieve a benefit whereby a lower force is required to move the centraliser 1 into the smaller diameter bore section of the bore since the impact is applied to a longer moment arm provided by the positioning of the first pivot axis 11*a* away from the third pivot axis 13*a*, increasing a torque applied to deflect the spring elements 9 to move the arm assemblies radially inwards.

In the illustrated example of FIGS. 2A to 2F, the first pivot axes 11*a* are coincident with (i.e. intersecting) the central longitudinal axis 4 of the device 1. With the arm assemblies 3 arranged in two orthogonal diametrically opposite pairs, the first pivot axes 11*a* in the first pair of arm assemblies 3 are coincident with a first plane 4A (refer FIG. 2C) coincident with the central longitudinal axis 4 of the device 1, and the first pivot axes 11*a* in the second pair of arm assemblies are coincident with a second plane 4B (refer FIG. 2C) coincident with the central longitudinal axis 4 of the device 1, with the second plane 4B orthogonal to the first plane 4A. In the first pair, the second pivot axis 12*a* is on the same side of the plane 4A to the third pivot axis 13*a*, and in the second pair, the second pivot axis 12*a* is on the same side of the plane 4B to the third pivot axis 13*a*.

The first pivot joints 11 in each pair of arm assemblies 3 may be axially offset at each support member, by axially offsetting the two arm assemblies in each pair of arm assemblies. Alternatively, and as illustrated by the example of FIGS. 2A to 2F, in each pair of diametrically opposite arm assemblies, the first pivot axes 11*a* of the pair of arm assemblies 3 are collinear, such that the first arms 5 pivot on the respective first or second support member 7, 8 on a common pivot axis 11*a*. Such an arrangement makes for efficient use of the annular space between the mandrel 10 and the bore wall, achieves a shorter length device 1 and/or reduces complexity.

Figure 4A:
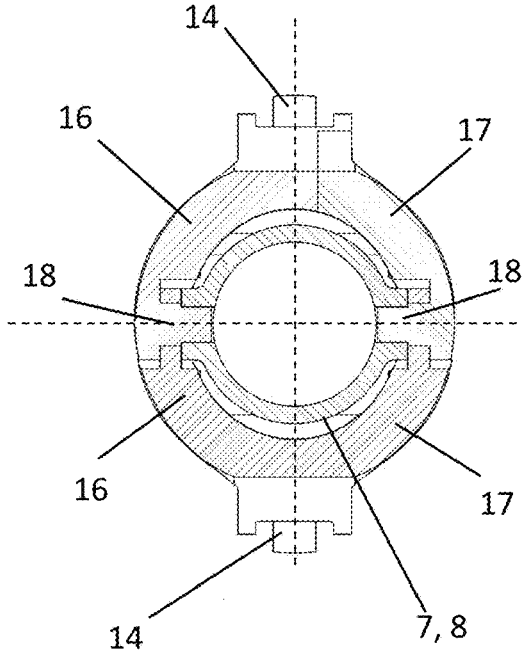
FIGS. 4A to 4C show a sliding support member and two pivotally attached first arms of the centralisers of FIGS. 2A to 2F and 3A to 3F.
Figure 4B:
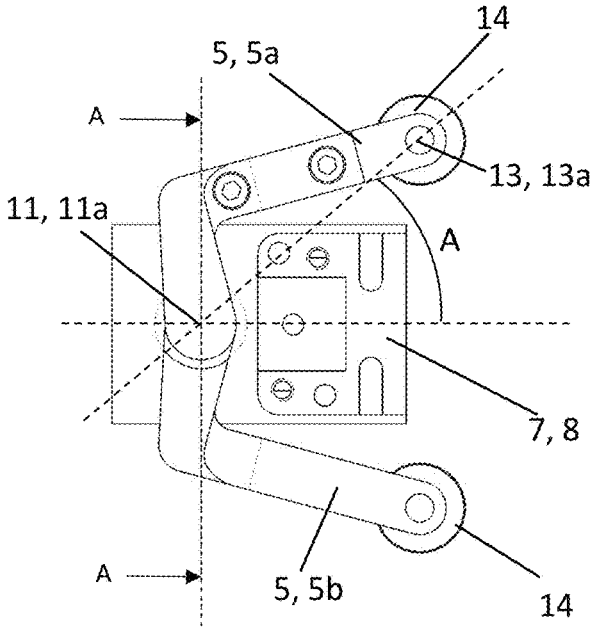
Figure 4C:
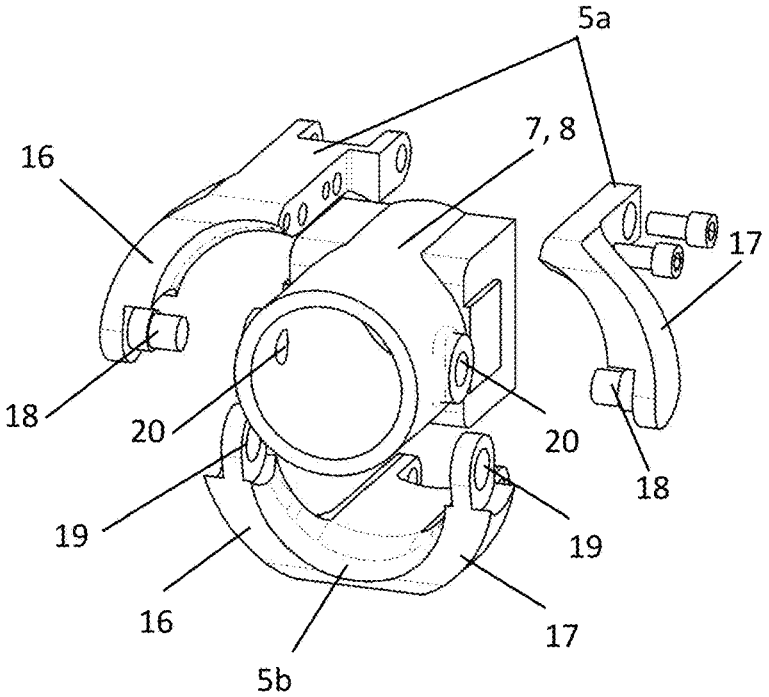
Figure 5A:
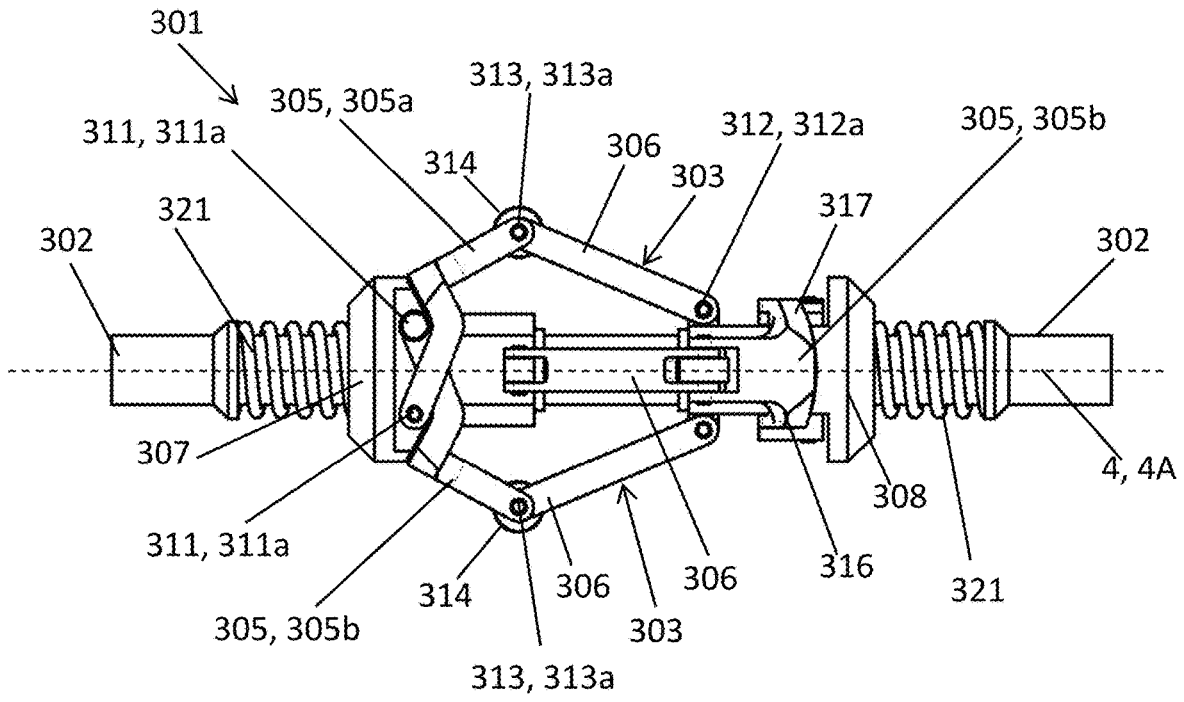
FIGS. 5A to 5F provide schematic representations of a centralising device according to another example of the present invention.
Figure 5B:
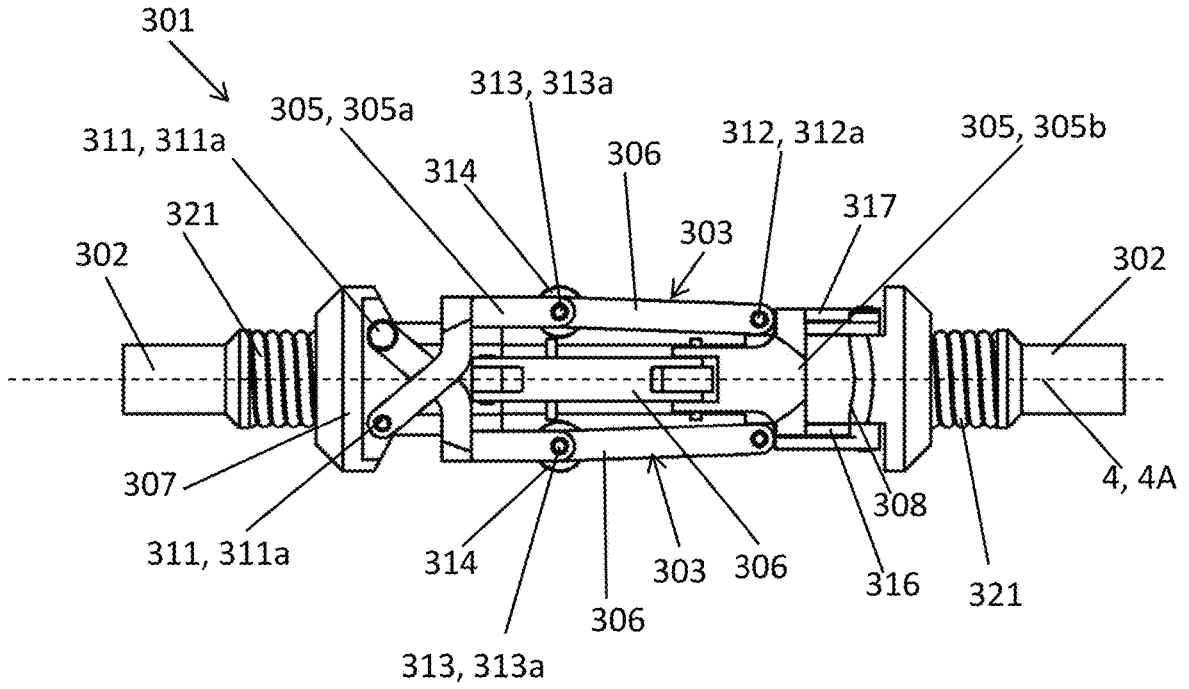
Figure 5C:
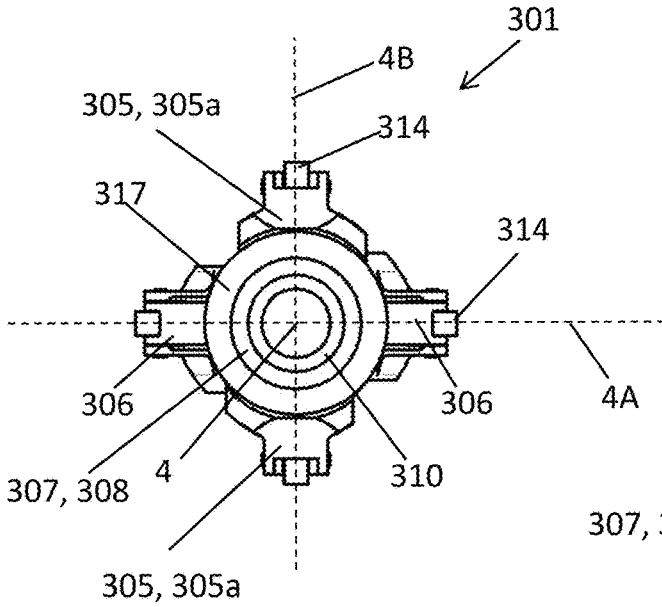
Figure 5D:
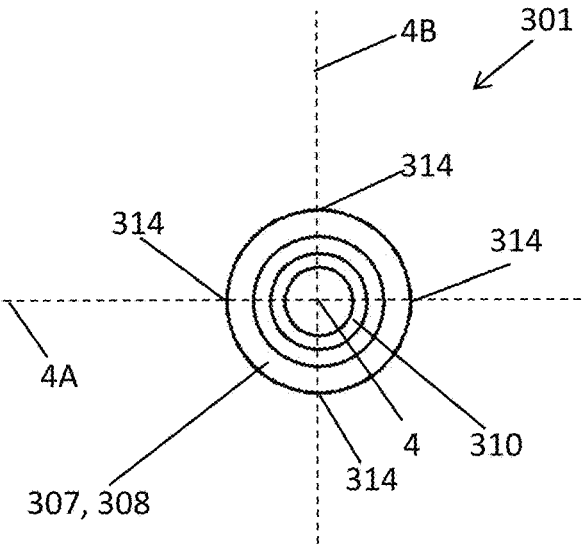
Figure 5E:
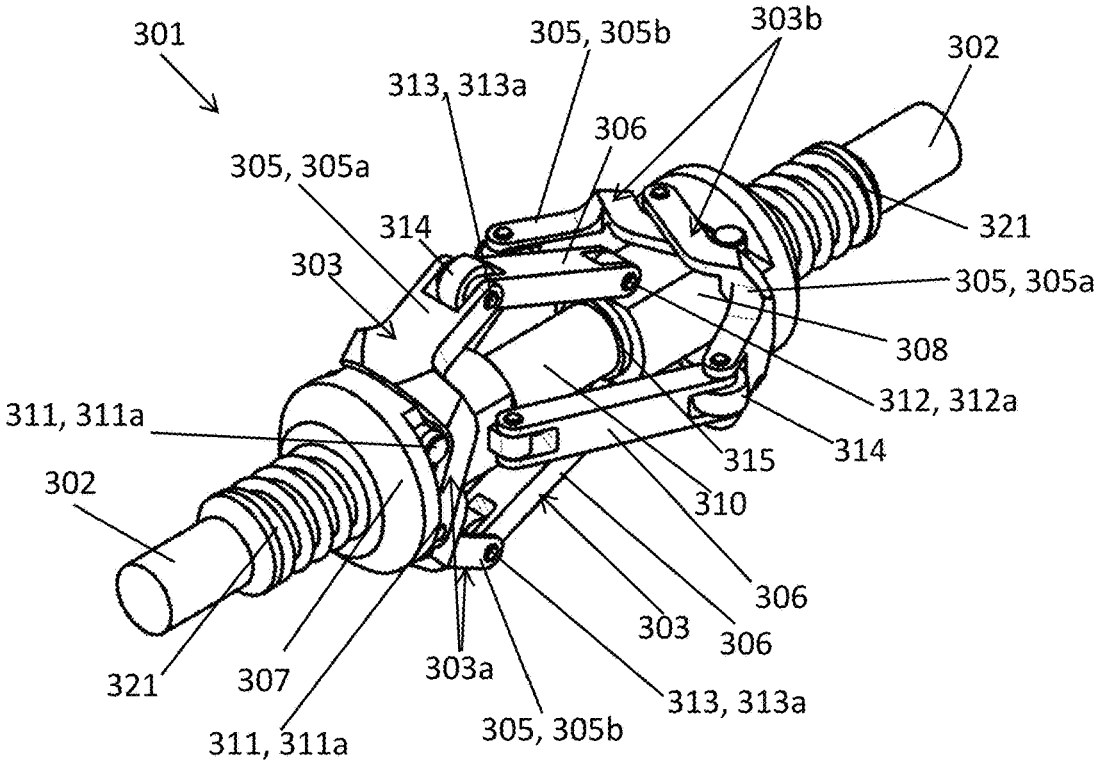
Figure 5F:
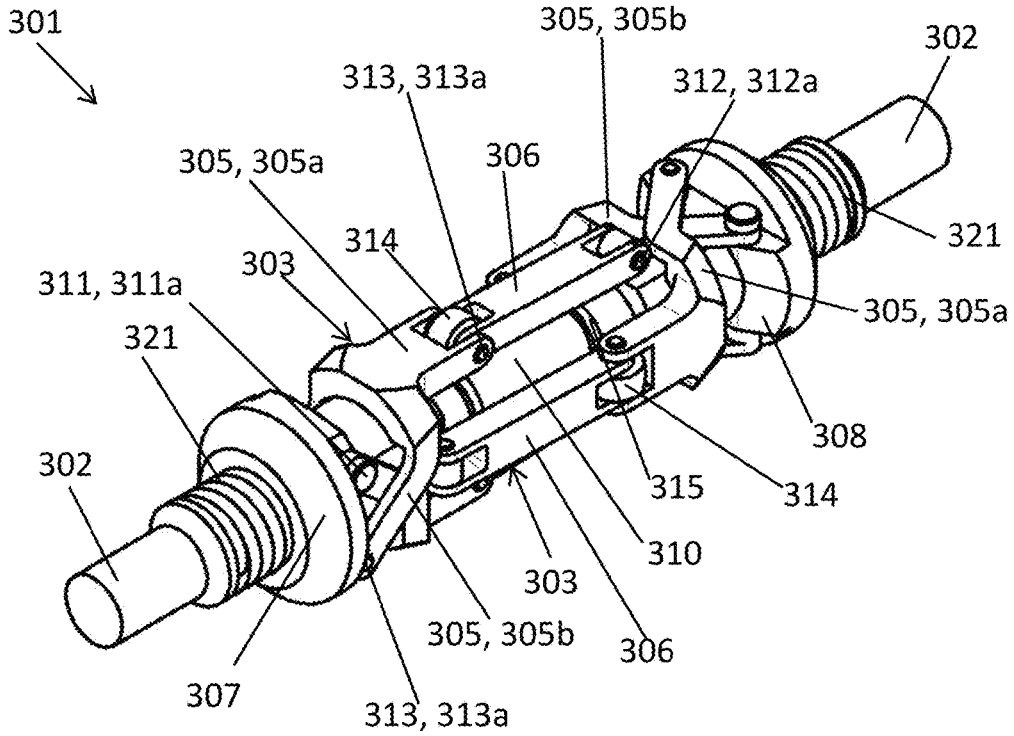

To achieve colinear first pivot axes at the support member, with reference to FIGS. 4A to 4C, in each pair of arm assemblies 3, one of the first arms 5*a* comprises a pair of colinear pivot pins 18 spaced apart by the fork section of the first arm 5*a*. The pins 18 are received in corresponding bearing portions 20 on opposed sides of the support member 7, 8 to pivotally connect the first arm 5*a* to the support member 7, 8. The other one of the first arms 5*b* in the pair of arm assemblies 3 comprises a pair of colinear eyes 19 spaced apart by the fork section of the first arm 5*b*. The eyes 19 are received on the pins 18, such that the pair of first arms 5*a*, 5*b* are pivotally connected to pivot on the support member 7, 8 on a common pivot axis 11*a*. In this example, the first pivot joint 11 for one arm 5*a* comprises the two pivot pins 18 and the corresponding bearing portions 20, and the first pivot joint for the other arm comprises the two eyes 19, the two pins 18 and the two bearing portions 20.

As best shown in FIG. 4C, the first arm 5*a* comprising the pivot pins 18 is provided in two parts, each part providing one limb 16, 17 of the fork section with a corresponding pin 18. The two parts are assembled on the support member 7, 8 with the pins 18 received in the bearing portions 20 and the eyes 19 of the fork section of the other first arm 5*b* received on the pins 18, to retain and pivotally connect both first arms 5*a*, 5*b* to the support member 7, 8. Thus, the first arm 5*b* comprising a fork section with eyes 19 is captured between the support member 7, 8 and the first arm 5*a* comprising a fork section with pins 18. The first arm comprising eyes may be formed as a single unitary member, i.e. not assembled from more than one part. The limbs of the fork section of one first arm 5*b* are received radially inside the limbs of the fork section of the other first arm 5*a*.

In the illustrated embodiment of FIGS. 2A to 2F, each first arm comprises the forked section and an elongate or non-bifurcated section (a single elongate or non-bifurcated section) extending between the fork section and the third pivot joint 13, i.e. the arm comprises an elongate section extending from the third pivot joint 13 and divides into the two limbs 16, 17 of the fork section to extend around the respective support member 7, 8. The elongate section pivots in a plane coincident with the central longitudinal axis 4 of the device, e.g. as shown by arm 5*b* in FIG. 2A. Again, with reference to FIGS. 4A to 4C, in the illustrated example, the two parts of the first arm 5*a* with pivot pins 18 each comprise a fork limb 16 or 17 and a portion of the elongate section of the arm 5*a*. The two parts of the arm 5*a* are clamped or held together at the elongate section of the arm by fasteners.

The example device of FIGS. 2A to 2F comprises leaf springs to bias the arms assemblies 3 radially outwards. A spring 9 is provided to each arm assembly. The leaf spring 9 is mounted to a support member 7, 8 to act between the support member 8 and the arm assembly 3 to provide a radial outward force to the arm assembly 3. Each spring 9 acts against a corresponding second arm 6, to bias the arm assemblies 3 radially outwards. The illustrated example comprises a spring 9 per arm assembly, however, a device may comprise one or more springs acting on one arm assembly, or two arm assemblies, or all of the arm assemblies as illustrated. Alternatively, one or more springs may act between the mandrel 10 and the arm assembly 3 or assemblies 3.

In the alternative example of FIGS. 3A to 3F, the centraliser 201 has an axial spring 209 acting on each support member 207, 208 to bias the support members 207, 208 axially together to thereby bias the arm assemblies 203 radially outwards against the wellbore wall 102*a*. Where one of the support members 207, 208 is fixed against axial movement, the centraliser 201 is without a spring acting on the fixed support member. The axial spring(s) 209 may be coil springs that are colinear with the mandrel 210 as shown in the illustrated embodiment or may include a plurality of coil springs arranged circumferentially (azimuthally spaced apart) around the mandrel.

Those skilled in the art will understand that other types of springs and spring configurations may be used to power the centraliser such as torsion springs and Belleville Washers for example. A combination of two or more spring devices may also be used, for example one or more springs may be provided end-to-end to impart a combined non-linear spring rate. Alternatively, the pitch of the coil spring may vary over its length to provide a non-linear spring rate. A centraliser according to the present invention may have only axial springs, only radial springs, or a combination of both axial and radial springs. A combination of both axial and radially acting springs may be used to provide a relatively constant radial force.

Device 201 has many of the same or similar parts/features as described above with reference to the example device of FIGS. 2A to 2F. Same or similar parts/features already described above with reference to FIGS. 2A to 2F are identified by the same reference numerals in FIGS. 3A to 3F but with an added prefix of '2' or '20'. The device of FIGS. 3A to 3F is therefore not described for brevity, other than noting the difference in spring configuration between the two example devices 1, 201 described in the above preceding paragraphs. It is also noted that the incorporation of axial springs may achieve a reduction in overall length of the device 1, 201. Leaf springs 9 may require longer arm assemblies 3 to incorporate the leaf springs acting on one of the arms in one or more arm assemblies. Axial springs 221 arranged as shown in FIGS. 3A to 3F add length to the device 201 beyond the support members 207, 208, however, a length reduction may be achieved by having a spring 221 acting on one support member 207, 208 only, or by incorporating axial springs arranged circumferentially (azimuthally spaced apart) around the mandrel interposed between adjacent arm assemblies 203, as described in U.S. Pat. No. 11,136,880, the contents of which are incorporated herein by reference.

For an axial spring configuration, the arm angle may be maintained within a range to achieve a relatively constant radial force. The arm assemblies provide a mechanical advantage (mechanical leverage) between the axial displacement and the radial displacement to provide, in combination with the axial spring elements 221, a radial force to the bore wall 102*a*. The mechanical advantage changes with the axial and radial position of the arm assemblies 203. The mechanical advantage of each arm assembly 203 may be expressed as Fr/Fa, where Fa is the axial force provided by the axial spring element(s) 221 on the arm assembly and Fr is the resulting radial force applied to the wellbore wall 102*a*. As the mechanical advantage increases, the radial force, transferred from the axial spring force to the wellbore wall increases. The mechanical advantage is dependent on the angle between each arm and the centreline of the device and increases as the angle increases. Thus, the mechanical advantage of the arm assembly 203 increases with increasing well bore diameter. In balance with the mechanical advantage, the spring(s) 221 provide(s) a force that decreases with increasing wellbore diameter, since the support members 207, 208 slide axially to decompress the spring. Conversely, as the wellbore diameter decreases, the mechanical advantage decreases and the axial spring force increases as the spring is further compressed by the sliding support member 207, 208. To achieve a relatively constant force, the arm angle of at least one of the arms 5, 6 should be much greater than 10 degrees and much less than 75 degrees. The angle is preferably maintained in a range of 20 to 70 degrees, or more preferably 25 to 65 degrees. In the illustrated embodiment, the arm angle for the first arm 205 is in the range of 25 degrees to 60 degrees as the arm assemblies move from the radially inwards position to the radially outwards position.

FIGS. 5A to 5F illustrate a further example of a centralising device 301 with arm assemblies 303 each comprising an arm 305 with a fork section extending around opposed sides of a corresponding or respective support member 307, 308. Parts/features in the example of FIGS. 5A to 5F that are the same as or similar to parts/features in the example of FIGS. 2A to 2F and already described above are identified by the same reference numerals appearing in FIGS. 2A to 2F but with an added prefix of '3' or '30'. The same or similar features or configurations are not described again for brevity.

In each arm assembly 303, limbs 316, 317 (refer FIG. 6B) of the fork section of the first arms 305 extend around opposed sides of the support member 307, 308. As briefly mentioned above, in the example of FIGS. 5A to 5F, for each arm assembly 303, the fork section extends on opposed sides of the respective support member 307, 308 so that the first pivot axis 311*a* is on an opposite side of a plane 4A, 4B coincident with the longitudinal axis 4 of the device 301 to the third pivot axis 313*a*, or in other words, the first pivot axis 311*a* and the third pivot axis 313*a* are positioned on opposite sides of the plane 4A, 4B.

Like the configuration described above for the example of FIGS. 2A to 2F, in the example of FIGS. 3A to 3F, the arm assemblies 303 are arranged in two diametrically opposite pairs 303*a*, 303*b*. The two pairs 303*a*, 303*b* of arm assemblies 303 are arranged so that the first arms 305 of the arm assemblies 303 in one pair (first pair 303*a*) are pivotally coupled to the first support member 307, and the first arms 305 of the arm assemblies 303 in the other pair (second pair 303*b*) are pivotally coupled to the second support member 308. This provides for two diametrically opposite forked arm connections at each support member 307, 308 and avoids interference between the forked arms at each support member as the arms pivot between radially inward and radially outward positions.

With the arm assemblies 303 arranged in two orthogonal diametrically opposite pairs, in each arm assembly 303 in the first pair of diametrically opposite arm assemblies, the first pivot axis 311*a* and the third pivot axis 313*a* are positioned on opposite sides of the first plane 4A (ref FIG. 5C) coincident with the central axis 4 of the device 301, and for each arm assembly in the second pair of diametrically opposite arm assemblies 303, the first pivot axis 311*a* and the third pivot axis 313*a* are positioned on opposite sides of a second plane 4B (refer FIG. 5C) coincident with the central longitudinal axis of the device, with the second plane orthogonal to the first plane. In the first pair, the second pivot axis 312*a* is on the same side of the plane 4A to the third pivot axis 313*a*, and in the second pair, the second pivot axis 312*a* is on the same side of the plane 4B to the third pivot axis 313*a*.

Figure 6A:
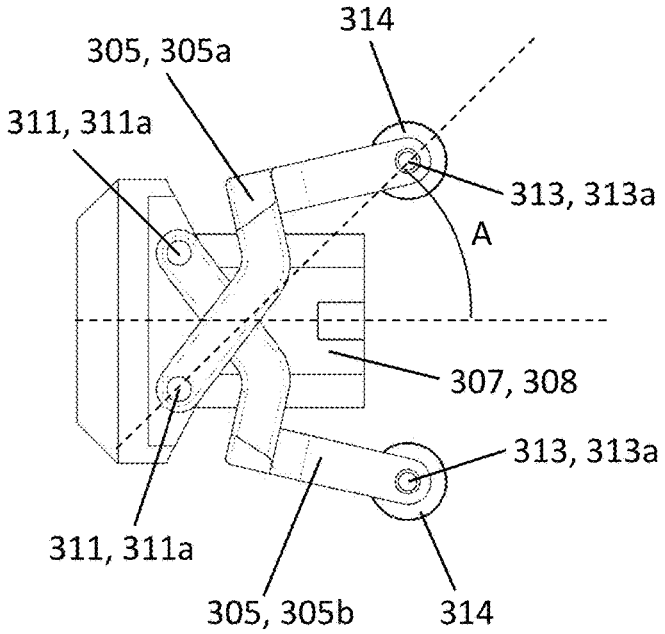
FIGS. 6A and 6B FIG. 6A is a side view of a sliding support member and two pivotally attached first arms of the centraliser of FIG. 5A to 5F, and FIG. 6B a trimetric view of the arms with the support member and pivot pins of first pivot joints omitted.
Figure 6B:
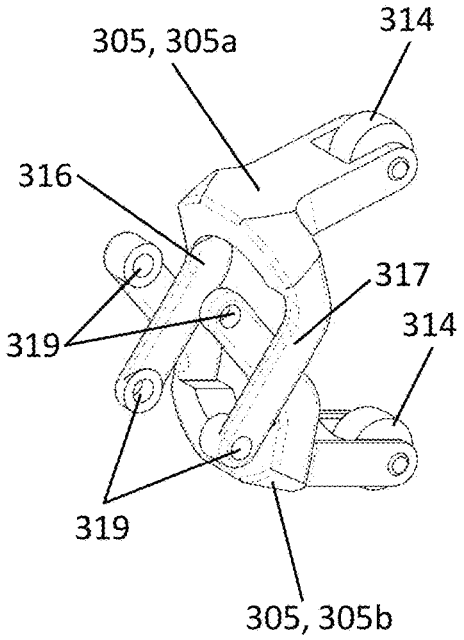
Figure 7A:
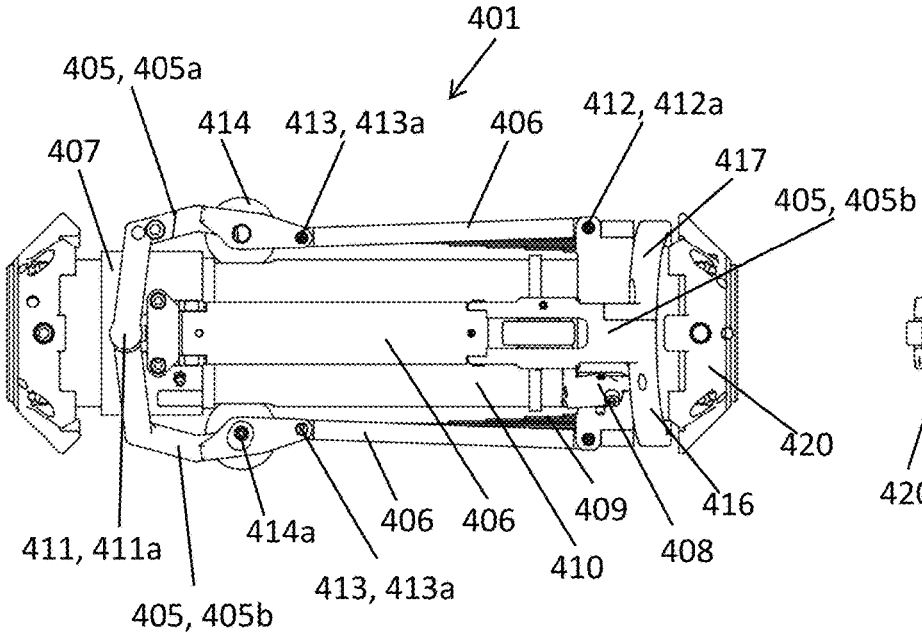
FIGS. 7A to 7D illustrate a further example of a centralising device according to one or more aspects of the present invention.
Figure 7B:
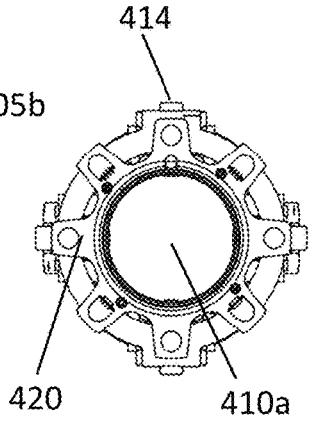
Figure 7C:
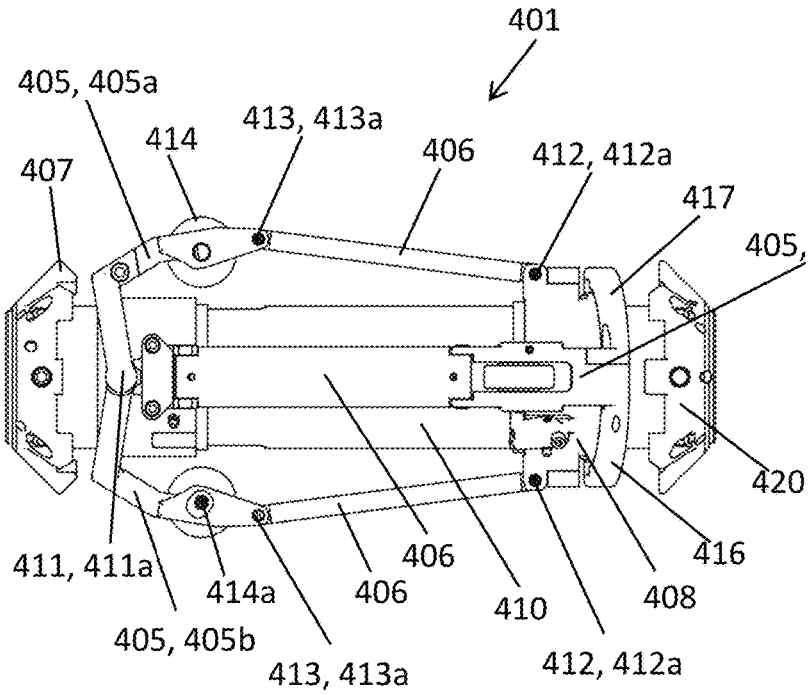
Figure 7D:
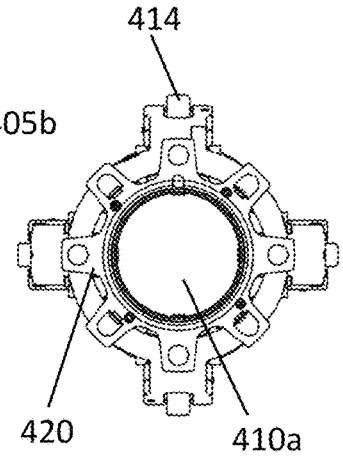

With reference to FIGS. 6A and 6B, in the example of FIGS. 5A to 5F, to accommodate the two first arms 305 of the diametrically opposite arm assemblies 303 at the respective support member 307, 308, the fork section of one of the first arms 305*a* laterally crosses over the fork section of the other one of the first arms 305*b*, as shown in the side view of FIG. 6A, i.e. the limbs of one fork section cross the limbs of the other fork section. The fork sections are laterally offset, with each fork section having one limb laterally outside and one limb laterally inside the fork section of the other first arm, as shown in FIG. 6B, such that the fork sections laterally cross over without interference between the arms. In the illustrated embodiments, the two first arms 305*a*, 305*b* are identical, with one arm 305*a* rotated 180 degrees relative to the other arm 305*b*. Alternatively, the fork section of one first arm 305*a* may be received radially inside (with respect to the central axis of the device) the fork section of the other first arm 305*b*, .i.e. the limbs 316, 317 of the forked section of one first arm 305*b* may be received radially inside the limbs 316, 317 of the fork section of the other first arm 305*a*. In each pair of arm assemblies, the first pivot axes 311*a* of the two arm assemblies (at the respective support member 307, 308) are axially aligned.

In each pair of arm assemblies 303, the fork section of each of the first arms 305*a*, 305*b* is pivotally connected to the support member by a pivot pin extending through the support member and eyes 319 (FIG. 6B) of the fork section. Alternatively, the pivot joint may comprise pins (stub axles) on the support member or the fork section of one or both first arms may comprise a pair of colinear pivot pins spaced apart by the fork section of the first arm, the pins received in corresponding bearing portions on opposed sides of the support member 307, 308.

In the illustrated example, the first arms 305 are each provided as single unitary members. Alternatively, one or both first arms may be provided in two parts, e.g. each part providing one limb 316, 317 of the fork section, e.g. in a similar assembly to the arm of the earlier example device 1. As described for the example of FIGS. 2A to 2F, each first arm comprises the fork section and a single elongate section extending between the fork section and the third pivot joint 313.

The example device of FIGS. 5A to 5F comprises axial springs 321 acting on the support members 307, 308, like in the example of the device of FIGS. 3A to 3F. However, the device of FIGS. 5A to 5F may include alternative spring arrangements as described earlier, such as radial springs acting on the arm assemblies, like the leaf spring arrangement in the example embodiment of FIGS. 2A to 2F.

In the alternative example of FIGS. 7A to 7D, the centraliser 401 is configured as a slip over device, comprising a mandrel 410 with an internal bore 410*a* configured to slip over an outside of a wireline logging tool (housing). The centraliser 401 has its wheel rotational axis 414*a* a distance from the respective third pivot joint 413 and pivot axis 413*a*, i.e. in each arm assembly the third pivot axis and the wheel rotational axis are parallel and spaced apart, and are therefore not colinear. The third pivot axis is radially outside of the outside diameter of the wheel with respect to the rotational axis of the wheel. The centraliser further comprises a deflector or protection member 420 at each end of the device to act as a bumper to protect the arms from collisions as the device 401 traverses a bore. Centraliser 401 is powered by leaf springs 409 (not shown in FIG. 7C and obscured from view in FIGS. 7B and 7D) as described above for the embodiment of FIGS. 2A to 2F. Centraliser 401 has many of the same or similar parts/features as described above with reference to the device 1 of FIGS. 2A to 2F. Same or similar parts/features already described above with reference to FIGS. 2A to 2F are identified by the same reference numerals in FIGS. 7A to 7D but with an added prefix of '4' or '40'. The device of FIGS. 7A to 7D is therefore not described in detail, other than noting the differences between the two example devices 1, 401 as described above.

A further alternative embodiment 501 is illustrated in FIGS. 8A to 8F. Centraliser 501 has many of the same or similar parts/features as described above with reference to the device 1 of FIGS. 2A to 2F. Same or similar parts/features already described above with reference to FIGS. 2A to 2F are identified by the same reference numerals in FIGS. 8A to 8D but with an added prefix of '5' or '50'. Some same or similar parts/features are not described again for brevity.

The centraliser 501 is configured as a slip over device, comprising a mandrel 510 with an internal bore 510*a* configured to slip over an outside of a wireline logging tool (housing). Alternatively, a mandrel with end connections may be provided to connect inline within a tool string. Centraliser 501 provides a further example embodiment in which the first pivot axis 511*a* is located radially within the OD of the mandrel 510. In Centraliser 501, the first and third pivot axes 511*a*, 513*a* are located on the same side of the plane (4A or 4B) coincident with the central longitudinal axis 4 of the centraliser. The first arm 505 of each arm assembly 503 comprises a fork section comprising two limbs 516, 517. The limbs 516, 517 of the fork of the first arm 505 extend on opposed sides of the respective support member 507, 508, so that the first pivot axis 511*a* is located radially within the OD of the mandrel 510 with the first pivot axis 511*a* and the third pivot axis 513*a* on the same side of the plane 4A, 4B. The first pivot axis extends through the mandrel 510 on which the first and/or second support member 507, 508 slides. In the illustrated embodiment, the first pivot axis extends through the bore 510*a* of the mandrel 510. Thus, the first pivot axis extends through the tool string on which the centraliser 501 is assembled in use.

Figure 8A:
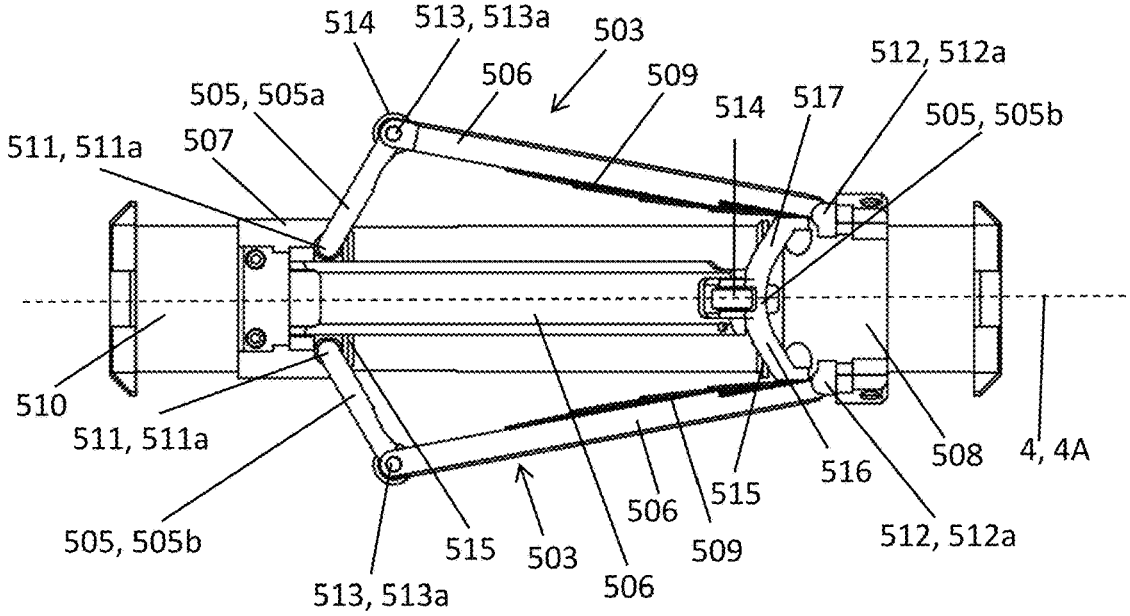
FIGS. 8A to 8F provide schematic representations of a centralising device according to another example of the present invention.
Figure 8B:
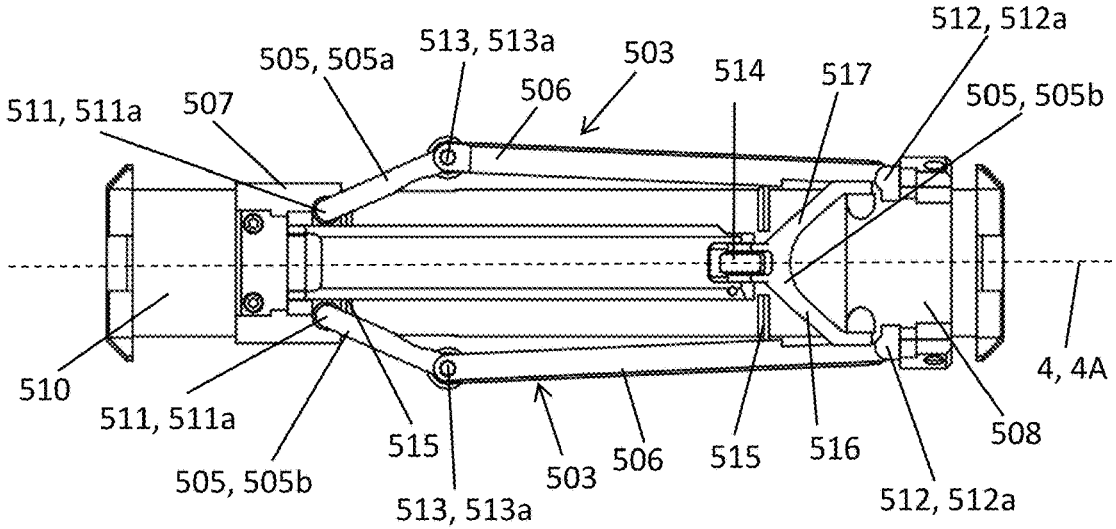
Figure 8C:
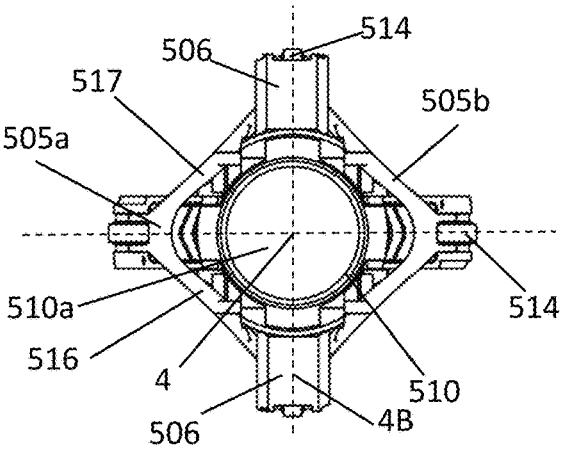
Figure 8D:
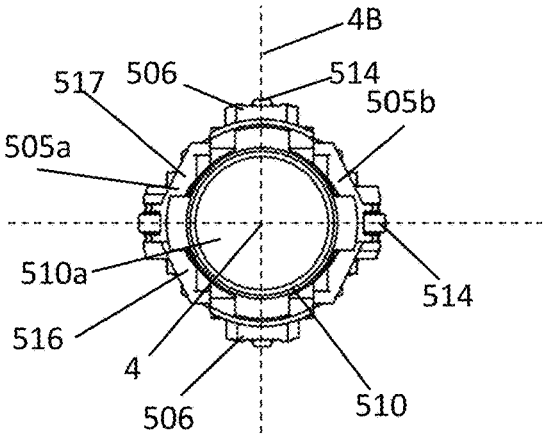
Figure 8E:
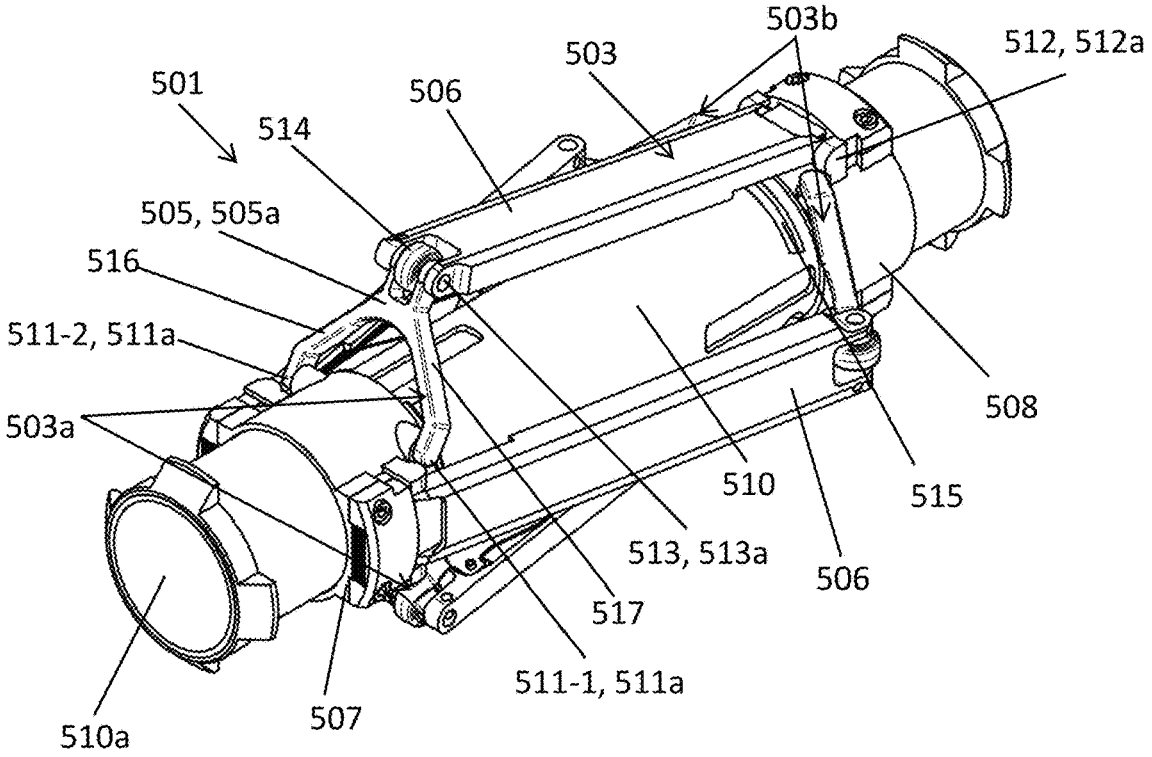
Figure 8F:
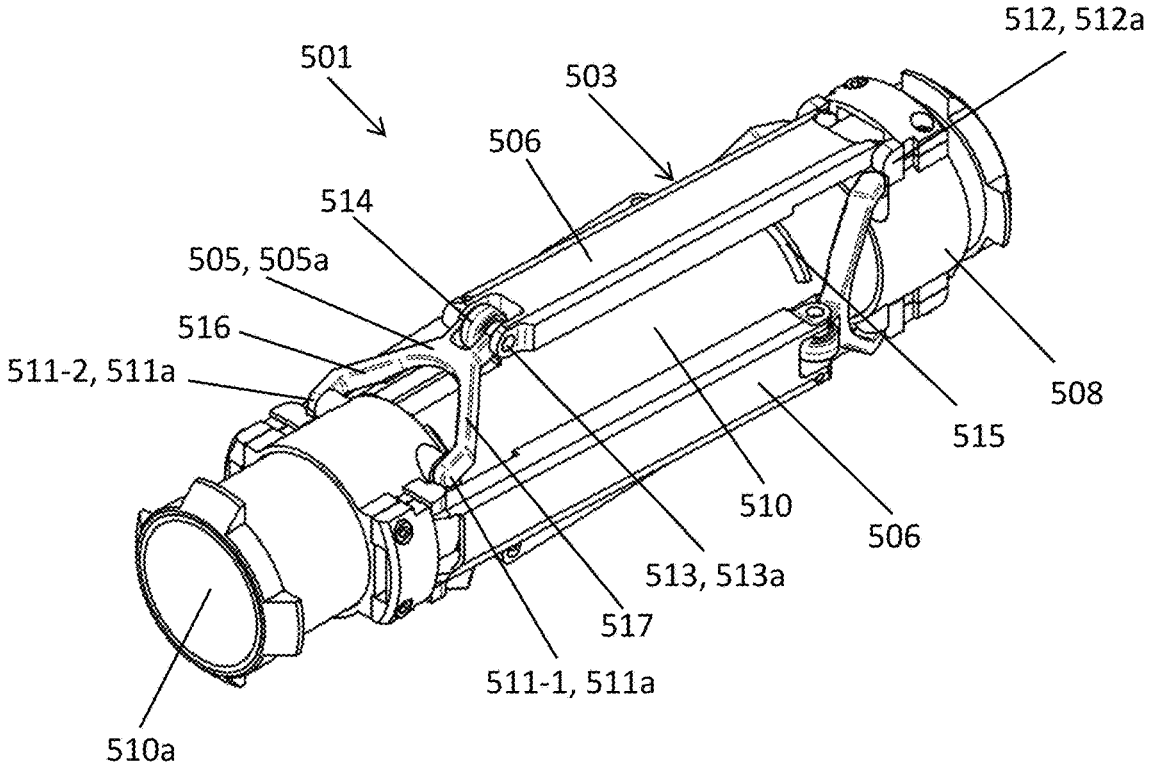

As in the earlier described embodiments, the first pivot joint 511 comprises two spaced apart colinear first pivot joints (511-1, 511-2 FIGS. 8E and 8F). Each pivot joint 511-1, 511-2 comprises a pivot pin. The two first pivot joints 511-1, 511-2 are colinear on the first pivot axis 511*a*. The two spaced apart first pivot joints 511-1, 511-2 are located on opposite sides of the respective support member 507, 508. The two colinear first pivot joints 511-1, 511-2 are located on opposite sides of a first plane 4A, 4B coincident with the central longitudinal axis of the centraliser, and with the first pivot axis 511*a* and the third pivot axis 513*a* located on the same side of a second plane 4B, 4A coincident with the central longitudinal axis of the centraliser. The second plane is orthogonal to the first plane.

As described in the earlier embodiments, each first arm comprises the fork section and a non-bifurcated section between the fork section and the third pivot joint 513, i.e. the arm comprises a single non-bifurcated section extending between the fork section and the third pivot joint 513. The non-bifurcated section divides into the two limbs 516, 517 of the fork section to extend around the respective support member 507, 508. Each of the two limbs 516, 517 of the forked section extend from the first pivot axis 511*a* and join at the non-bifurcated section between the fork section and the third pivot joint 513. The non-bifurcated section pivots in a plane coincident with the central longitudinal axis 4 of the device.

The forked section of the first arm extends for a significant portion of a total length of the first arm to extend around opposed sides of the support member 507, 508. For example, the forked section has a length of at least half the length of the first arm.

As described above in relation to the first embodiment 1, the arm assemblies 503 are arranged in two diametrically opposite pairs, a first pair and a second pair, with the second pair 503*b* of arm assemblies orthogonal to the first pair 503*a* of arm assemblies. The two pairs of arm assemblies are arranged so that the first arms 505 of the arm assemblies 503 in the first pair are pivotally coupled to the first support member 507, and the first arms 505 of the arm assemblies 503 in the second pair are pivotally coupled to the second support member 508. To accommodate the first 511 and second 512 pivot joints at each support member 507, 508, the first pair of diametrically opposite arm assemblies is axially offset from the second pair of diametrically opposite arm assemblies. In the first embodiment described above, the first and second pairs of diametrically opposite arm assemblies are axially offset so that the second pivot joints 12 of the first and second pair of arm assemblies are located axially between the first pivot joints 11 of the first and second pair of arm assemblies. In the embodiment of FIGS. 8A to 8F, the first pair of diametrically opposite arm assemblies is axially offset from the second pair of diametrically opposite arm assemblies so that the first pivot joints 511 of the first and second pair of arm assemblies are located axially between the second pivot joints 512 of the first and second pair of arm assemblies.

Centraliser 501 is powered by leaf springs 509 (obscured from view in FIG. 8A and not shown in FIG. 8B) as described above for the first embodiment of FIGS. 2A to 2F. The leaf springs are mounted to a respective first or second support member 507, 508 to act against a respective second arm 506 to bias the arm assemblies 503 radially outwards.

In all of the above-described embodiments, the relative positioning of the pivot axes is achieved by the first arms having fork sections. However, the relative positioning of the pivot axes may be achieved by an arm without a fork section, the arm extending on one side of the support member only, by for example an arm extending approximately helically around the mandrel. However, such an arrangement is less preferred as the centering force applied by the arm assemblies against the wellbore wall may result in a torque applied to the support member and pivot joints.

A centraliser according to one or more aspects of the present invention as described above provides one or more of the following benefits. The relative positioning of the arm assembly pivot points effectively increases the length of the arm of the arm assemblies for a given diameter and length centraliser, improving the bore diameter range over which the centraliser can operate. Furthermore, the minimum arm angle is increased which improves the coupling between the plurality of arm assemblies to ensure the arms act together to effectively centralise the device in the bore. An increase in minimum arm angle is also beneficial for ensuring a satisfactory mechanical advantage particularly important where axial spring(s) acting on the support member(s) are utilised.

Further, increasing the minimum arm angle can assist in achieving a constant radial centering force. The disclosed arm arrangements can also present a longer moment arm to reduce the force required to collapse the centraliser when moving into a bore or lower diameter section of a bore. The described arm arrangements achieve compact arm configurations for efficient utilisation of the available annual space between the mandrel or sensor assembly and the ID of the wellbore, may achieve a shorter length device, and reduce complexity. Furthermore, the centraliser is a passive device, with energisation being provided by the mechanical spring components 9, 221, 321 only. No other power input, such as electrical or hydraulic power provided from service located power units is required. The invention therefore provides a lower cost, effective, and simplified device that provides improved operational reliability and accuracy of logged data.

The invention has been described with reference to centering a tool string in a wellbore during a wireline logging operation. However, a centralising device according to the present invention may be used for centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for centering a sensor assembly in a bore, the device comprising:

a first support member and a second support member axially spaced apart along a central longitudinal axis of the device, the first and second support members configured to move axially along the central longitudinal axis, wherein the first and second support members each comprise a collar colinear with and received on the mandrel to slide thereon, a plurality of arm assemblies pivotally connected between the first and second support members, the plurality of arm assemblies spaced circumferentially apart around the central longitudinal axis, wherein each arm assembly comprises:

a first arm pivotally attached to one of the first and second support members by a first pivot joint having a first pivot axis, a second arm pivotally attached to the other one of the first and second support members by a second pivot joint having a second pivot axis, the first and second arms pivotally attached together via a third pivot joint having a third pivot axis, and wherein the first arm comprises a fork section extending around opposite sides of the respective first or second support member to position the first pivot axis radially within an outer diameter of a mandrel on which the respective first or second support members moves axially.

2. The device as claimed in claim 1, wherein the fork section extends around opposite sides of the respective first or second support member to position the first pivot axis and the third pivot axis on the same side of a plane coincident with the central longitudinal axis.

3. The device as claimed in claim 1, wherein the fork section extends around opposite sides of the respective first or second support member to position the first pivot axis coincident with the central longitudinal axis.

4. The device as claimed in claim 1, wherein the fork section extends around opposite sides of the respective first or second support member to position the first pivot axis and third pivot axis on opposite sides of a plane coincident with the central longitudinal axis.

5. The device as claimed in claim 1, wherein the first pivot joint comprises a pair of colinear pivot pins spaced apart by the forked section, the pivot pins located on opposite sides of the respective first or second support member.

6. The device as claimed in claim 1, wherein the arm assemblies are arranged in two diametrically opposite pairs, a first pair of diametrically opposite arm assemblies and a second pair of diametrically opposite arm assemblies, and wherein in the first pair of diametrically opposite arm assemblies, the first arms are pivotally connected to the first support member and the second arms are pivotally connected to the second support member, and in the second pair of diametrically opposite arm assemblies, the first arms are pivotally connected to the second support member and the second arms are pivotally connected to the first support member.

7. The device as claimed in claim 6, wherein, for each arm assembly in the first pair of diametrically opposite arm assemblies, the first pivot axis is coincident with a first plane coincident with the central longitudinal axis of the device, and for each arm assembly in the second pair of diametrically opposite arm assemblies, the first pivot axis is coincident with a second plane coincident with the central longitudinal axis of the device, wherein the second plane is orthogonal to the first plane.

8. The device as claimed in claim 7, wherein in each pair of diametrically opposite arm assemblies, the first pivot axes of the pair of arm assemblies are colinear, such that the first arms pivot on the respective first or second support member on a common pivot axis.

9. The device as claimed in claim 8, wherein in each pair of diametrically opposite arm assemblies:

one of the first arms comprises a pair of colinear pivot pins spaced apart by the fork section, the other one of the first arms comprises a pair of colinear eyes spaced apart by the fork section, the eyes received on the pins, and the pins received in corresponding bearing portions on opposed sides of the respective first or second support member to pivotally connect the first arms to the respective first or second support member to pivot on the respective first or second support member on the common pivot axis.

10. The device as claimed in claim 6, wherein, for each arm assembly in the first pair of diametrically opposite arm assemblies, the first pivot axis and the third pivot axis are positioned on opposite sides of a first plane coincident with the central longitudinal axis of the device, and for each arm assembly in the second pair of diametrically opposite arm assemblies, the first pivot axis and the third pivot axis are positioned on opposite sides of a second plane coincident with the central longitudinal axis of the device, wherein the second plane is orthogonal to the first plane.

11. The device as claimed in claim 10, wherein, the fork sections of the first pair of diametrically opposite arm assemblies laterally cross over such that the first pivot axis and the third pivot axis of each arm assembly in the first pair of diametrically opposite arm assemblies are positioned on opposite sides of the first plane, and the fork sections of the second pair of diametrically opposite arm assemblies laterally cross over such that the first pivot axis and the third pivot axis of each arm assembly in the second pair of diametrically opposite arm assemblies are positioned on opposite sides of the second plane.

12. The device as claimed in claim 6, wherein in each pair of diametrically opposite arm assemblies, the forked section of one first arm is received radially inside the fork section of the other first arm.

13. The device as claimed in claim 1, wherein the first arm of each arm assembly comprises a non-bifurcated section between the fork section and the third pivot joint, and the forked section comprises two limbs diverging from the non-bifurcated section to extend around opposite sides of the respective first or second support member.

14. The device as claimed in claim 1, wherein the device comprises one or more spring elements to bias the arm assemblies radially outwards.

15. The device as claimed in claim 1, wherein the second pivot axis is radially outside the outer diameter of the mandrel on which the other one of the first and second support member moves axially.

16. The device as claimed in claim 15, wherein the device comprises a plurality of leaf springs corresponding with the plurality of arm assemblies, each leaf spring acting against a corresponding second arm to bias the arm assemblies radially outwards.

* * * * *